US011879213B2

(12) United States Patent
Pereira Maia et al.

(10) Patent No.: US 11,879,213 B2
(45) Date of Patent: Jan. 23, 2024

(54) FIBRE COMPOSITION, USE OF SAID COMPOSITION AND ARTICLE COMPRISING SAID COMPOSITION

(71) Applicant: SUZANO S.A., Pituba Salvador (BR)

(72) Inventors: Elenice Pereira Maia, Americana São Paulo (BR); Fábio Carucci Figliolino, Vila Monte Sion (BR)

(73) Assignee: SUZANO S.A., Pituba Salvador (BR)

( * ) Notice: Subject to any disclaimer, the term of this patent is extended or adjusted under 35 U.S.C. 154(b) by 214 days.

(21) Appl. No.: 17/413,497

(22) PCT Filed: Dec. 10, 2019

(86) PCT No.: PCT/BR2019/050530

§ 371 (c)(1),
(2) Date: Jun. 11, 2021

(87) PCT Pub. No.: WO2020/118400

PCT Pub. Date: Jun. 18, 2020

(65) Prior Publication Data

US 2022/0380980 A1 Dec. 1, 2022

(30) Foreign Application Priority Data

Dec. 11, 2018 (BR) ..... BR 10 2018 075755

(51) Int. Cl.
*D21H 15/02* (2006.01)
*D21H 11/04* (2006.01)
*D21H 11/18* (2006.01)

(52) U.S. Cl.
CPC ..... *D21H 15/02* (2013.01); *D21H 11/04* (2013.01); *D21H 11/18* (2013.01)

(58) Field of Classification Search
CPC ..... D21H 15/02; D21H 11/04; D21H 11/02; D21H 11/14; D21H 11/18; D21C 9/007
See application file for complete search history.

(56) References Cited

U.S. PATENT DOCUMENTS

| | | | | |
|---|---|---|---|---|
| 5,288,690 | A | 2/1994 | Warner et al. | |
| 7,381,294 | B2 * | 6/2008 | Suzuki | D21D 1/30 162/187 |
| 9,856,607 | B2 | 1/2018 | Hua et al. | |
| 10,640,632 | B2 * | 5/2020 | Laukkanen | C08L 1/02 |
| 2004/0048206 | A1 | 3/2004 | Miyake et al. | |
| 2014/0093648 | A1 | 4/2014 | Puukko et al. | |
| 2015/0225550 | A1 | 8/2015 | Banzashi et al. | |
| 2019/0119854 | A1 | 4/2019 | Knox et al. | |
| 2021/0221988 | A1 * | 7/2021 | Hara | B32B 15/08 |
| 2021/0395949 | A1 * | 12/2021 | Silveira | D21H 11/18 |
| 2022/0064858 | A1 * | 3/2022 | Imai | C08L 1/02 |
| 2022/0380980 | A1 * | 12/2022 | Pereira Maia | D21C 9/007 |

FOREIGN PATENT DOCUMENTS

| | | | | |
|---|---|---|---|---|
| BR | 112015003819-0 | A8 | 8/2017 | |
| BR | 102018075755 | A2 * | 6/2020 | D21H 11/04 |
| EP | 0637351 | B1 | 11/1996 | |
| EP | 1538257 | A1 * | 6/2005 | D21D 1/20 |
| EP | 3059344 | A1 * | 8/2016 | D21H 19/82 |
| EP | 3390458 | B1 * | 7/2022 | C08L 1/02 |
| EP | 3896220 | A4 * | 8/2022 | D21H 11/04 |
| JP | 2013540913 | A * | 11/2013 | D21H 11/04 |
| WO | 201/054968 | A1 | 5/2012 | |
| WO | 2013183007 | A1 | 12/2013 | |
| WO | 2014031737 | A1 | 2/2014 | |
| WO | WO-2020118400 | A1 * | 6/2020 | D21H 11/04 |

OTHER PUBLICATIONS

Rosa, Jeferson Monteiro, "Written Opinion", International Application No. PCT/BR2019/050530, dated Mar. 30, 2020, 15 pages.
Baharlou, Simin, "International Preliminary Report on Patentability", International Application No. PCT/BR2019/050530, dated Jun. 8, 2021, 7 pages.
Guay et al., "Comparison of Fiber Length Analyzers", TAPPI Practical Papermaking Conference Proceedings, May 22-26, 2005, 31 pages.
Lopes et al., "The effect of surface modifications with corona discharge in pinus and eucalyptus nanofibril films", Cellulose, 25, Jul. 20, 2018, 5017-5033.
Oglesby et al., "Does kraft hardwood and softwood pulp viscosity correlate to paper properties?", TAPPI Journal, vol. 15, No. 10, Oct. 2016, 643-651.
Casey, James P., "Pulp and Paper", Chemistry and Chemical Technology, Third Edition, vol. I, Awiley-Interscience Publication, 1980, 8 pages; cited in foreign counterpart; no English translation; The Pulp and Paper Chemistry and Chemical Technology discloses that there is a certain relationship between the viscosity of fibre and the strength of fibre composition.

* cited by examiner

*Primary Examiner* — Jose A Fortuna
(74) *Attorney, Agent, or Firm* — Arrigo, Lee, Guttman & Mouta-Bellum LLP; Carla Mouta-Bellum

(57) ABSTRACT

The present invention relates to a high-strength fibre composition comprising fibres up to 7 mm long with a viscosity of between 10 and 20 cP. The fibres present in said composition are distributed according to the length thereof, thereby guaranteeing high strength. The fibre composition according to the invention can also be redispersible. The use of the fibre composition according to the invention and an article comprising said composition are also disclosed.

23 Claims, 19 Drawing Sheets

FIBRE COMPOSITION, USE OF SAID COMPOSITION AND ARTICLE COMPRISING SAID COMPOSITION

FIELD OF THE INVENTION

The present invention relates to a high-strength fibre composition comprising fibres up to 7 mm long with a viscosity of between 10 and 20 cP. The fibres present in said composition are distributed according to the length thereof, thereby guaranteeing high strength. The fibre composition of the invention can also be redispersible.

The use of the fibre composition according to the invention and an article comprising said composition are also disclosed.

CROSS-REFERENCE TO RELATED APPLICATIONS

This application is a U.S. National Stage Entry of International Application No. PCT/BR2019/050530, filed Dec. 10, 2019, which claims priority to Brazilian Application No. BR 10 2018 075755, filed Dec. 11, 2018, the contents of both of which are hereby incorporated by reference in their entireties.

BACKGROUND OF THE INVENTION

Functional and process additives are commonly used in the paper and textile industry to improve material retention, sheet strength, hydrophobicity, among other features. Water-soluble synthetic polymers or emulsifiers, resins derived from petroleum or modified natural products, and cellulose derivatives obtained by dissolving cellulose pulp are usually used as additives.

On the other hand, materials using recyclable natural fibres have received attention recently due to the growing environmental awareness as a substitute to petroleum resources, as described in document US 2015/0225550. According to said document, among the natural fibres, a cellulose fibre having a fibre diameter of 10 to 50 μm, particularly a cellulose fibre derived from wood (pulp), has been widely used for this purpose, mainly as a paper product.

In view of the environmental and technical context presented, natural fibre products that have, among other advantages, high strength, redispersibility and fibre size that facilitates the easy bond between the fibres are sought.

There are state of the art documents which disclose compositions containing natural fibres. State of the art documents U.S. Pat. No. 9,856,607, WO 2013/183007, US 2015/0225550 and BR 11 2015 003819 0, for example, disclose cellulose fibre compositions (natural fibres) having different physical chemical properties and applications. However, conventional refining processes for fibre refining of cellulose fibre compositions are carried out with low energy levels, as described in document BR 11 2015 003819 0. The use of low energy levels does not guarantee the appropriate distribution of fibre sizes in order to provide high strength to the composition.

The present invention differs from all cited documents mainly by the distribution by fibres length. Fibre length and distribution present in the fibre composition of the invention allows an interaction between the fibres to occur, promoting better interlacing and greater bonding strength, which affects the composition's behavior and mechanical properties. Additionally, the viscosity range of the present invention and the fact that it is redispersible allow a better fibre availability to carry out their bonds, thus promoting better mechanical properties.

The present invention, by presenting these characteristics, when added to the paper sheet, for example, promotes greater wet or dry strength, even if applied in small quantities. Thus, a solution different from those already existing in the state of the art for an elevated strength fibre composition is described herein.

Additionally, fibre refining of the cellulose fibre compositions of the invention is carried out with a high level of energy. This guarantees the appropriate distribution of the fibre sizes, which favors the interaction between the fibres and improves their physical-mechanical properties.

There is still a need in art for compositions that, in addition to presenting high strength, also present a viscosity that allows the good redispersibility of the composition. As explained, redispersibility allows fibres to be more available to make the high number of bonds, resulting in high strength.

Therefore, the technical problem that the present invention solves is the difficulty of maintaining the wet sheet strength during the process and after drying, and to form strong bonds and interlaces between the fibres for this purpose. Thus, with the fibre size distribution of the fibre composition of the invention, there is a gain in (wet and dry) sheet strength, as the fibre arrangement and distribution favors interlacing and strong bonds.

SUMMARY OF THE INVENTION

A fibre composition is described herein comprising fibres having a length equal or inferior to 7 mm and a viscosity between 10 and 20 cP.

The fibre composition of the invention comprises the following fibre length distribution, based on dry weight:

i. 0 to 0.2 mm: 1.7 to 33.7%, preferably 16.5%;
ii. 0.2 to 0.5 mm: 12.0 to 44.0%, preferably 29%;
iii. 0.5 to 1.2 mm: 22.0 to 83.0%, preferably 52%;
iv. 1.2 to 2.0 mm: 0.10 to 3.8%, preferably 1.6%;
v. 2.0 to 3.2 mm: 0.06 to 0.10%; and
vi. 3.2 to 7.0 mm: 0.03 to 0.30%, preferably 0.13%.

In one aspect of the invention, the fibres of the composition are natural fibres.

In some embodiments of the invention, natural fibres are selected from cellulose fibres, cellulose fibre derivatives, wood derivatives or mixtures thereof. In a preferred embodiment, the natural fibres are cellulose fibres.

Natural fibres of the composition can be virgin, recycled or secondary natural fibres.

In one aspect of the invention, the natural fibres of the composition are obtained via kraft process. In a preferred embodiment of the invention, the natural fibres are kraft cellulose fibres.

Natural fibres of the composition can be whitened, semi-whitened or not whitened; they may comprise lignin and/or hemicellulose; and can be long or short.

In one embodiment of the invention, the fibre composition presents a dry content in the range between 3 and 70%. In a preferred embodiment, the fibre composition presents a dry content in the range between 20 and 50%.

In one aspect of the invention, the fibre composition is redispersible.

The fibre composition of the invention comprises 10,000 to 25 million fibres/g of the composition.

In one embodiment of the invention, the fibre composition has a fibre width of between 10 and 25 μm.

In one embodiment of the invention, the fibre composition has a polymerization degree of between 1,000 and 2,000 units.

In one embodiment of the invention, the fibre composition has a tensile index of between 70 and 100 Nm/g; elongation of between 2 and 5%; Scott Bond of between 180 and 300 ft·lb/in$^2$; and bursting index of between 4 and 9 KPam$^2$/g.

In one embodiment of the invention, the fibre composition has a body, also referred to as volume-to-mass ratio, of between 1 and 2 cm$^3$/g; Taber stiffness of between 0.3 and 5%; and wall thickness between 3 and 6 μm.

In one embodiment of the invention, the fibre composition has an opacity of between 30 and 80%.

In one embodiment of the invention, the fibre composition has a fines content of between 10 and 90% and fibrillation of between 5 and 20%.

In one embodiment of the invention, the fibre composition has Brookfield Viscosity at 1% of between 92 and 326 cP.

In one aspect of the invention, the fibre composition, when redispersed, presents at least 70% of the Brookfield Viscosity initial value at 1%.

In one aspect of the invention, the fibre composition is used in paper manufacturing, fibre cement, thermoplastic composites, inks, varnishes, adhesives, filters and wooden panels.

The use of the fibre composition of the invention for paper manufacturing, fibre cement, thermoplastic composites, inks, varnishes, adhesives, filters and wooden panels is also described herein.

An article comprising the fibre composition of the invention is also disclosed.

In one embodiment of the invention, the article is a paper, a fibre cement, a thermoplastic composite, an ink, a varnish, an adhesive, a filter or a wooden panel. In a preferred embodiment of the invention, the article is a paper.

DETAILED DESCRIPTION OF THE INVENTION

Figure 1:
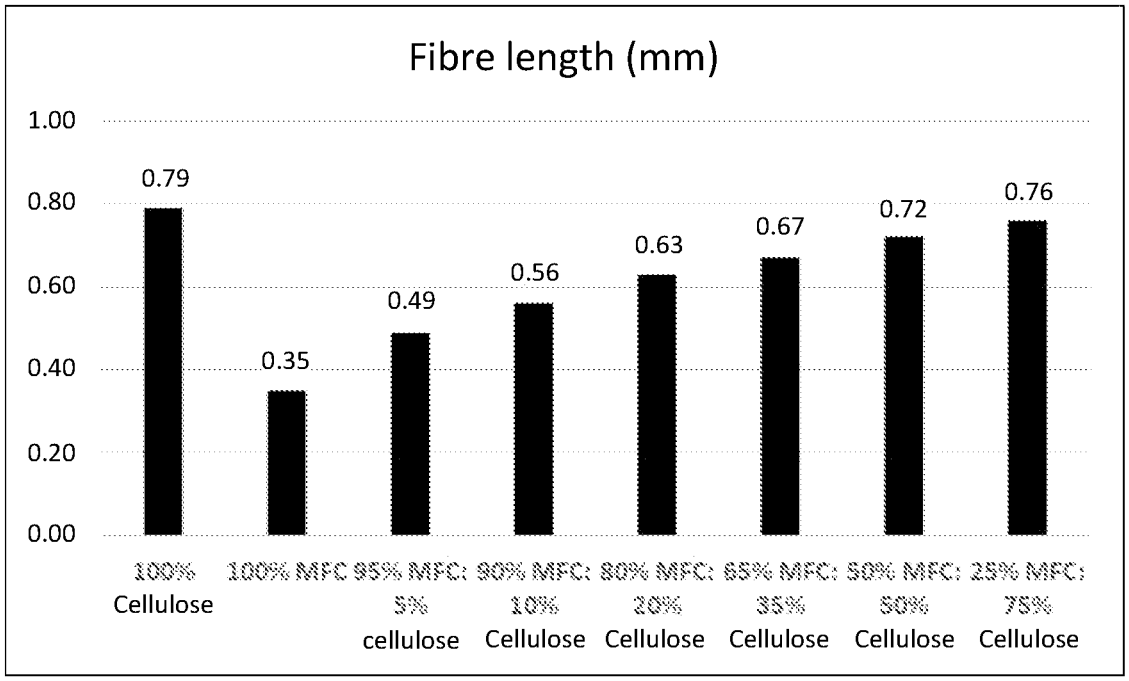
FIG. 01 depicts a length graph, in mm, of the formulations from example 1 of the invention.
Figure 2:
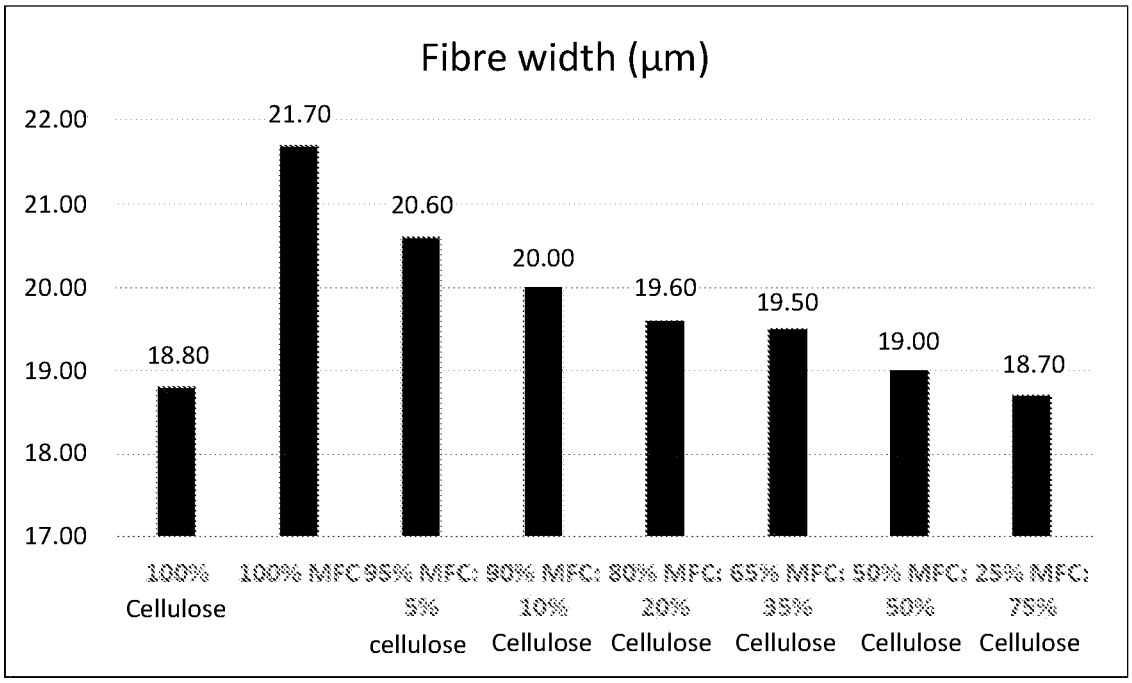
FIG. 02 depicts a fibres width graph, in μm, of the formulations from example 1 of the invention.
Figure 3:
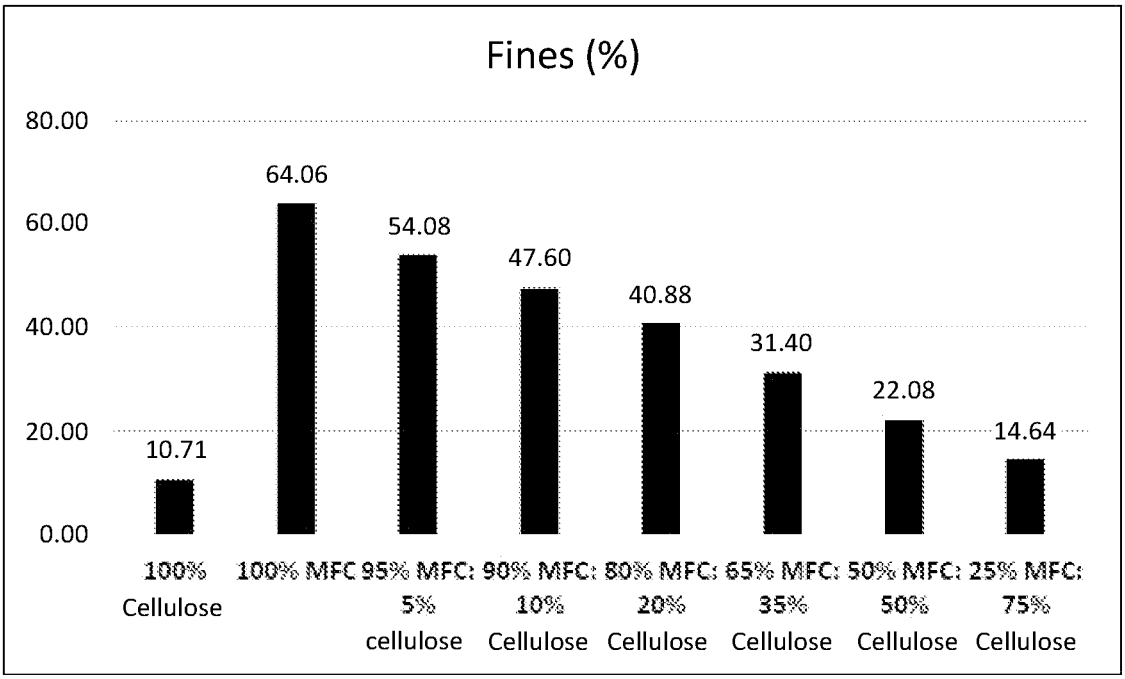
FIG. 03 depicts a fines content graph, in %, of the formulations from example 1 of the invention.
Figure 4:
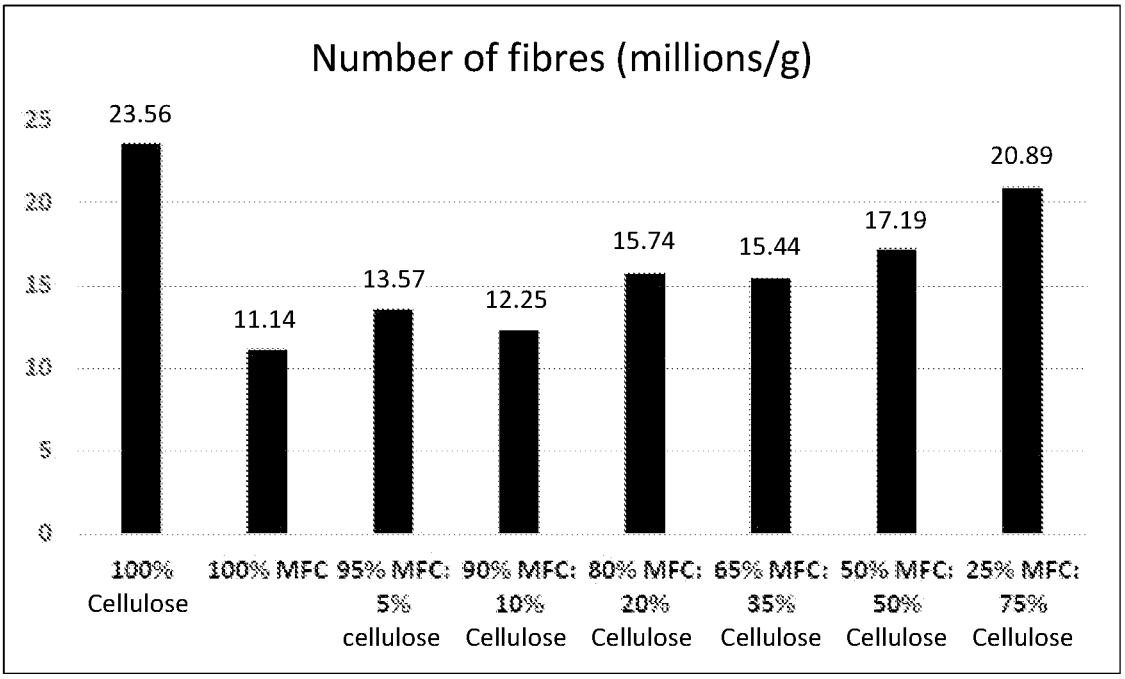
FIG. 04 depicts a graph of the number of fibres per mass from the composition, in millions/gram, of the formulations from example 1 of the invention.

The present invention provides a fibre composition that presents elevated strength, good processability and redispersibility, for application on paper, fibre cement, thermoplastic composites, inks, varnishes, adhesives, filters and wooden panels.

The invention is based on a fibre composition comprising fibres of length equal or inferior to 7 mm and a viscosity between 10 and 20 cP.

In a preferred embodiment of the invention, the fibre composition has a viscosity of 13 cP.

The term "length", as used herein, is defined as the largest fibre axis.

The term "viscosity" refers to the property which determines the fluid strength degree to a shear force.

The absolute (or dynamic) viscosity of a fluid is defined by the Newtonian equation:

$$\eta=\tau/\dot{y}$$

wherein $\eta$ is the absolute or dynamic viscosity, $\tau$ is the shear tension, and $\dot{y}$ is the speed gradient dv/dz (v being the speed of a plane relative to the other and z the coordinate perpendicular to the two planes).

Kinematic viscosity is defined as the relationship between absolute viscosity and the fluid specific mass, both measured at the same temperature and pressure.

Specific mass, in turn, is defined as the mass-to-volume ratio.

The term "viscosity" as used herein refers to absolute viscosity.

The fibre composition of the present invention comprises the following fibre length distribution, based on dry weight:

i. 0 to 0.2 mm: 1.7 to 33.7%, preferably 16.5%;
ii. 0.2 to 0.5 mm: 12.0 to 44.0%, preferably 29%;
iii. 0.5 to 1.2 mm: 22.0 to 83.0%, preferably 52%;
iv. 1.2 to 2.0 mm: 0.10 to 3.8%, preferably 1.6%;
v. 2.0 to 3.2 mm: 0.06 to 0.10%; and
vi. 3.2 to 7.0 mm: 0.03 to 0.30%, preferably 0.13%.

This distribution by fibre length allows interaction between the fibres, affecting the behavior and mechanical properties of the composition that comprises them and guaranteeing their elevated strength. The fibres of the invention go through a refining using high energy levels (in the range of 700 to 1,200 kwh/t, preferably 1,000 kwh/t) and reach a size and length distribution different from that observed in the art. This causes the fibre interaction to be established by these sizes and distribution and, therefore, the behavior of physical-chemical and mechanical properties is defined according to these interactions.

Cellulose fibres have many hydroxyl groups in their structure, which makes it possible to easily establish hydrogen bonding. When microfibrilated or nanofibrilated, this bonding capacity increases due to fibre sizes, interlacing and contact surfaces. Therefore, it is important to have the fibre size distribution as defined in the present invention. This fibre size distribution leads to the necessary size balance to promote better composition strength.

Thus, the interactions provided by the fibre length distribution of the invention result in compositions having elevated strength, which is propagated to the final product added with said composition.

In one aspect of the invention, the fibres of the composition are natural fibres.

As used herein, the term "fibre" means an elongated particulate having an apparent length that considerably exceeds its apparent width.

The term "natural fibres", as described herein, refers to cellulose fibres, cellulose fibre derivatives, wood derivatives or mixtures thereof.

In a preferred embodiment, the natural fibres are cellulose fibres.

Cellulose is the most abundant component of vegetables cell wall. The cellulose polymer empirical formula is $(C_6H_{10}O_5)n$, wherein n is the polymerization degree. This is one of the most abundant polymers on the planet. Cellulose is a long chain polymer and its repetition unit is called cellobiosis, which consists of two anhydroglucose rings joined by the β-1,4 glycosidic bond.

As used herein, the term "cellulose fibres" means fibres composed of or derived from cellulose.

In a preferred embodiment, the natural fibres are fibrillated cellulose fibres.

In a more preferred embodiment, the natural fibres are microfibrillated cellulose (MFC) fibres.

"Microfibrilated cellulose (MFC)" or "Microfibril" is a fibre or particle similar to a cellulose shank that is narrower and smaller than a pulp fibre normally used in paper applications.

Natural fibres can be virgin, recycled or secondary natural fibres.

As used herein, "recycled fibres" are non-smooth fibres that allow the fibres to separate from each other, resulting in less compact and more aerated compositions.

In one aspect of the invention, the natural fibres of the composition are obtained via kraft process. In a preferred embodiment of the invention, the natural fibres are kraft cellulose fibres.

The "kraft process" is the most dominant process in the paper and cellulose industry, in which wood chips are treated with a cooking liquor (a mixture of sodium hydroxide and sodium sulfide) over a temperature range of 150-180° C.

The composition natural fibres can be whitened, semi-whitened or not whitened; may comprise lignin and/or hemicellulose; and can be long (over 2 mm) or short (less than 2 mm).

Lignin is a phenolic polymeric material formed from phenolic precursors p-hydroxycinnamic alcohols, such as p-coumaryl alcohol, coniferyl alcohol and synaphyl alcohol through a metabolic pathway. Lignin and its derivatives are products of renewable origin that make up a green chemistry platform to replace raw materials of fossil origin, among other high value-added applications in various industries and segments.

In one embodiment of the invention, the fibre composition presents a dry content in the range between 3 and 70%. In a preferred embodiment, the fibre composition presents a dry content in the range between 20 and 50%.

The term "dry content", as described herein, refers to the solid content of the composition.

In one embodiment of the invention, the fibre composition has Brookfield Viscosity at 1% of between 92 and 326 cP.

The expression "Brookfield Viscosity" refers to a viscosity measurement performed using a Brookfield Viscometer.

In one aspect of the invention, the fibre composition is redispersible. When redispersed, the composition presents at least 70% of the Brookfield Viscosity initial value at 1%.

The fibre composition of the invention comprises 10,000 to 25 million fibres per gram of the composition.

In one embodiment of the invention, the fibre composition has a fibre width of between 10 and 25 μm. In a preferred embodiment, the fibre composition has a fibre width of between 18 and 22 μm. In a more preferred embodiment, the fibre composition has a fibre width of 20 μm. Even with the refining and smaller fibre size, the fibre width does not change significantly.

The term "width", as used herein, is defined as the smallest axis of the fibre.

In one embodiment of the invention, the fibre composition has a polymerization degree of between 1,000 and 2,000 units. In a preferred embodiment, the composition has a polymerization degree of between 1131 and 1710 units. In a more preferred embodiment, the fibre composition has a polymerization degree of 1248 units.

The polymerization degree (DP) is measured by the equation:

$$DP=1.75\times[\eta],$$

wherein [η] is the intrinsic viscosity and is calculated using the following equation:

$$[\eta]=\eta sp/(c(1+0.28\times\eta sp)),$$

wherein lisp is the specific viscosity and c represents the cellulose content at the time of the viscosity measurement.

Since this polymerization degree is also the average polymerization degree measured according to viscosimetry, this polymerization degree is also called "average polymerization viscosity degree".

In one embodiment of the invention, the fibre composition has a tensile index of between 70 and 100 Nm/g, preferably of between 70.8 and 94.6 Nm/g, more preferably of 93.1 Nm/g; elongation of between 2 and 5%, preferably of between 2.6 and 4.4%, more preferably 4.2%; Scott Bond of between 180 to 300 ft·lb/in$^2$, preferably between 198.5 and 248.0 ft·lb/in$^2$, more preferably 228 ft·lb/in$^2$; and bursting index of between 4 and 9 KPam$^2$/g, preferably of between 4.7 and 7.5 KPam$^2$/g, more preferably 7.5 KPam$^2$/g.

The expression "tensile index" is defined as the quotient between tensile strength and glue spread. Glue spread is the relationship between the paper mass and the area.

The term "elongation", as used herein, means how much the fibre composition can be elongated without breaking.

The expression "Scott Bond" means a type of mechanical physical test that determines the material's strength in the Z direction.

The expression "bursting index" means the quotient between the bursting strength, when the sheet is subjected to a specific pressure, by glue spread.

In one embodiment of the invention, the fibre composition has a body, also referred to as volume-to-mass ratio, of between 1 and 2 cm$^3$/g, preferably of between 1 to 1.5 cm$^3$/g, more preferably of 1 cm$^3$/g; Taber stiffness of between 0.3 and 5%, preferably of between 0.4 and 1.1%, more preferably of 0.4%; and wall thickness of between 3 and 6 μm, preferably of between 3 and 4 μm, more preferably of 3.5 μm.

The expression "body" is defined as the volume-to-mass ratio. The body, also referred to as volume-to-mass ratio, is a quantity inverse to the specific mass.

The expression "Taber stiffness" means the flexural strength of a material at a given angle. In the present invention the angle of 15° was used.

The expression "wall thickness" represents the wall width.

In one embodiment of the invention, the fibre composition has an opacity of between 30 and 80%, preferably of between 37.2 to 70.5%, more preferably of 41.7%.

The term "opacity" means the absence of transparency and determines the amount of light that can pass through the sheet and/or product.

In one embodiment of the invention, the fibre composition has a fines content of between 10 and 90%, preferably between 14 and 65%, more preferably of 60%, and fibrillation of between 5 and 20%, preferably of between 6 and 12%, more preferably of 8.6%.

The term "fines" means very small fibres and fibre fragments, for example, inferior to 2 mm in length.

The "fibrillation" is promoted by the fibre refining, which can be internal or external.

Internal fibrillation is the fibre swelling caused by water penetration into the cellulose fibres during the refining process, promoting the fibre swelling due to water molecules accommodation between the fibrils. Internal fibrillation makes fibres more flexible.

External fibrillation, in turn, is the fibrils or fibrillar units exposure during the mass refining operation, increasing the fibre specific surface for developing interfibrillary bonds during the formation of the paper sheet.

The fibre composition of the invention can alternatively be additivated with unrefined cellulose.

The fibre composition of the present invention is used in paper manufacturing, fibre cement, thermoplastic composites, inks, varnishes, adhesives, filters and wooden panels.

The invention is also based on the use of fibre composition for paper manufacturing, fibre cement, thermoplastic composites, inks, varnishes, adhesives, filters and wooden panels.

As used herein, the term "thermoplastic" means a plastic having the ability to soften and flow when subjected to a temperature and pressure increase, becoming a piece with defined shapes after cooling and solidification. New temperature and pressure applications promote the same softening and flow effect and new coolings solidify the plastic in definite shapes. Thus, thermoplastics have the capacity to undergo physical transformations in a reversible way, being able to go through this process more than once, thus maintaining the same features.

Additionally, the invention is based on an article comprising the fibre composition of the invention.

In one embodiment of the invention, the article is a paper, a fibre cement, a thermoplastic composite, an ink, a varnish, an adhesive, a filter or a wooden panel.

In a preferred embodiment of the invention, the article is a paper.

The use of the composition of the present invention promotes a significant gain in strength due to the fibres small size and the length distribution thereof, and a consequent increase in the number of bonds among them. As explained above, cellulose fibres have many hydroxyl groups in their structure, which allows for easy hydrogen bonding. When microfibrilated or nanofibrilated, this bonding capacity increases due to fibre sizes, interlacing and contact surfaces. Therefore, it is important to have the fibre size distribution as defined herein. Such fibre size distribution results in the necessary size balance to promote better sheet strength.

Other advantages of the fibre composition of the present invention are that it has good processability and promotes good redispersibility, due to its viscosity value combined with the distribution of fibre lengths.

EXAMPLES

The examples presented herein are non-exhaustive, serve only to illustrate the invention and should not be used as a basis for limiting it.

Example 1

This study assesses the morphological, physical and mechanical properties of the fibre composition of the invention comprising microfibrillated cellulose (MFC) fibres, whether or not additivated with kraft cellulose.

Formulation CO represents the MFC fibre composition of the invention, without whitened *eucalyptus* kraft cellulose additivation.

Formulations C5, C10, C20, C35, C50 and C75 represent MFC fibre compositions according to the invention, additivated with, respectively, 5%, 10%, 20%, 35%, 50% and 75% of whitened *eucalyptus* kraft cellulose.

Formulation C100 represents a formulation having 100% cellulose.

The morphological properties of the formulations are shown in Table 1.

TABLE 1

| Formulation | Length (mm) | Width (μm) | Fines (%) | # of fibres (million/g) |
|---|---|---|---|---|
| C100 | 0.79 | 18.80 | 10.71 | 23.56 |
| C0 | 0.35 | 21.70 | 64.06 | 11.14 |
| C5 | 0.49 | 20.60 | 54.08 | 13.57 |
| C10 | 0.56 | 20.00 | 47.60 | 12.25 |
| C20 | 0.63 | 19.60 | 40.88 | 15.74 |
| C35 | 0.67 | 19.50 | 31.40 | 15.44 |
| C50 | 0.72 | 19.00 | 22.08 | 17.19 |
| C75 | 0.76 | 18.70 | 14.64 | 20.89 |

The results obtained are presented in the graphs of FIGS. 01, 02, 03 and 04.

The viscosity values and polymerization degree (GP) of the formulations are shown in Table 2.

TABLE 2

| Formulation | Viscosity (cP) | Brookfield Viscosity (1%) (P) | Polymerization Degree (units) |
|---|---|---|---|
| C100 | 19.4 | 92 | 1773 |
| C0 | 12.0 | 326 | 1131 |
| C5 | 12.5 | 317 | 1218 |
| C10 | 13.0 | 309 | 1248 |
| C20 | 13.5 | 238 | 1311 |
| C35 | 14.3 | 174 | 1347 |
| C50 | 16.0 | 125 | 1514 |
| C75 | 18.0 | 102 | 1710 |

Figure 5:
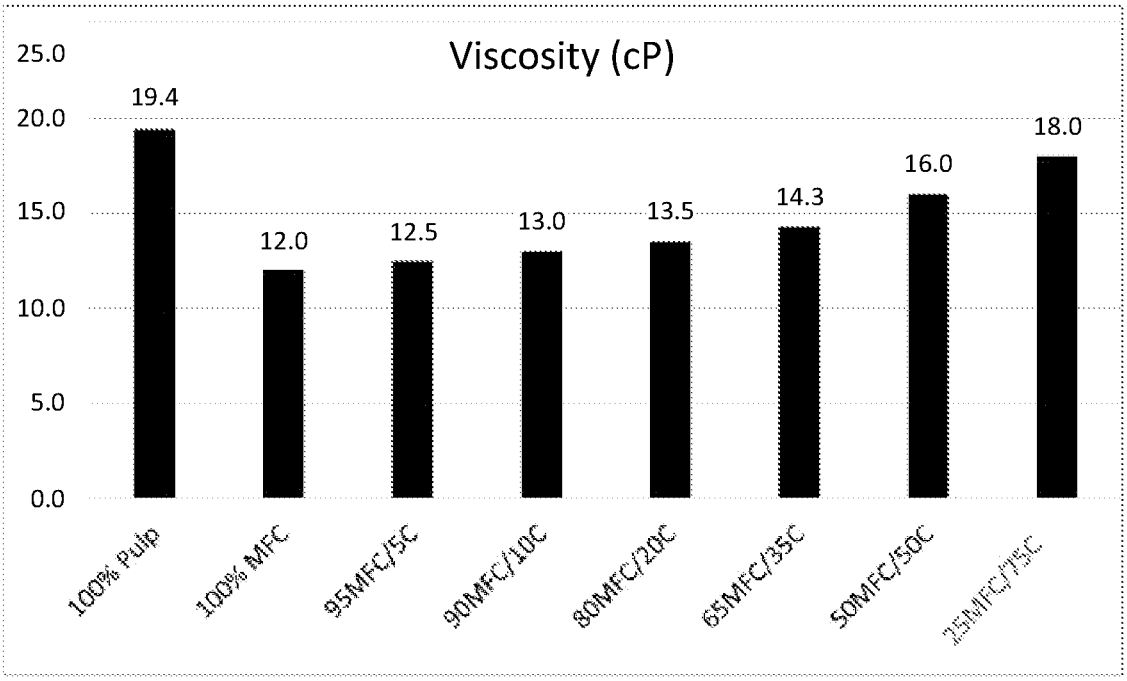
FIG. 05 depicts a viscosity graph, in cP, of the formulations from example 1 of the invention.
Figure 6:
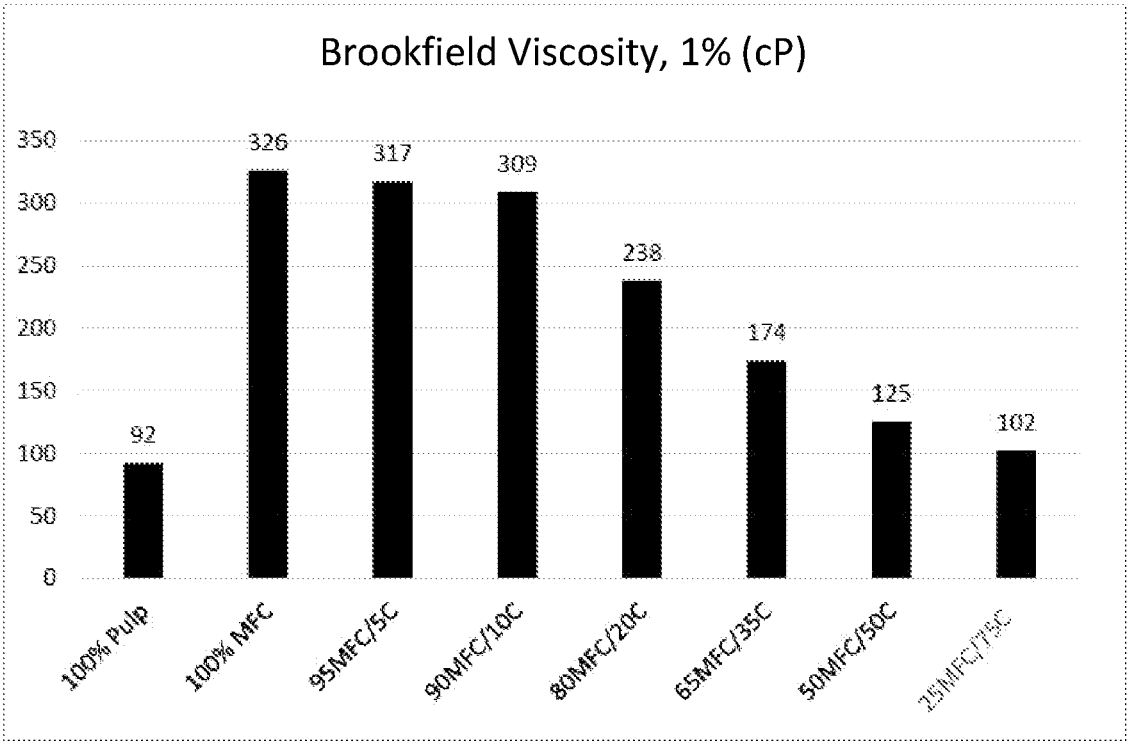
FIG. 06 depicts a Brookfield viscosity (1%) graph, in cP, of the formulations from example 1 of the invention.
Figure 7:
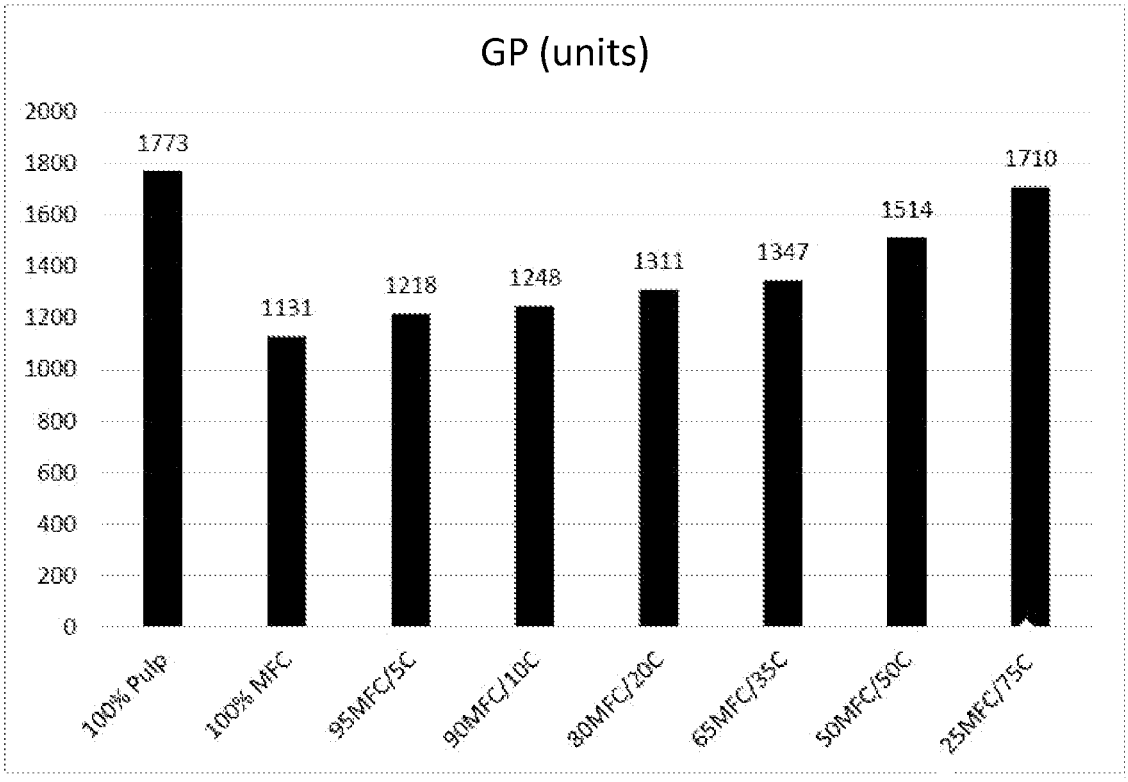
FIG. 07 depicts a polymerization degree graph, in units, of the formulations from example 1 of the invention.
Figure 8:
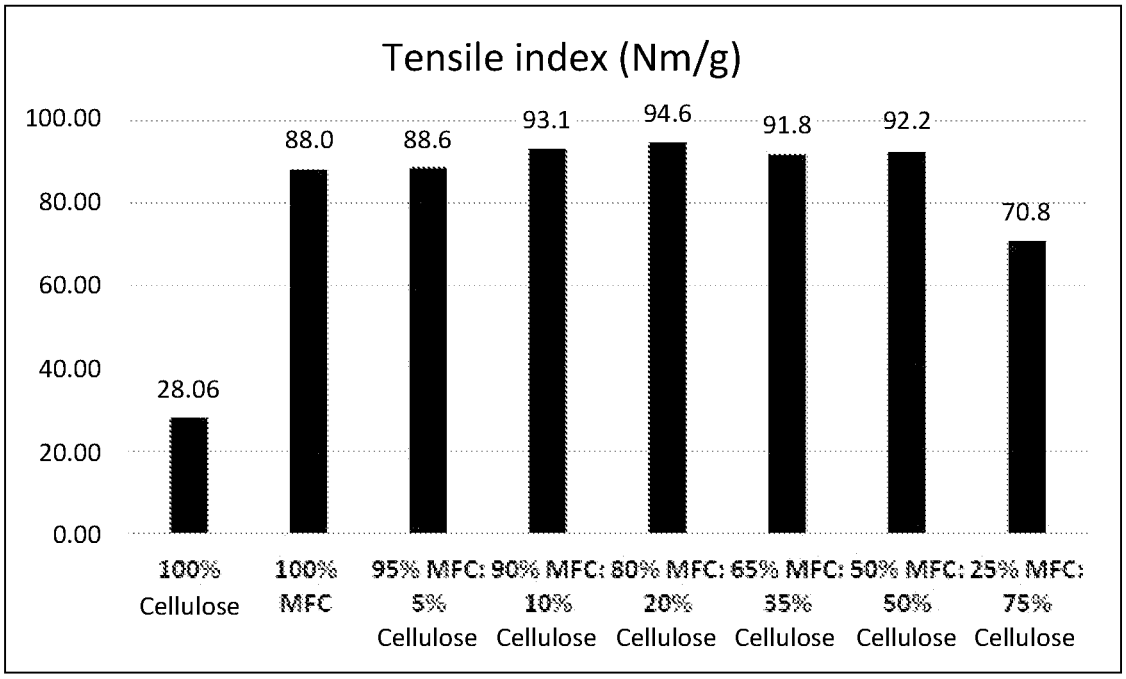
FIG. 08 depicts a tensile graph, in Nm/g, of the formulations from example 1 of the invention.
Figure 9:
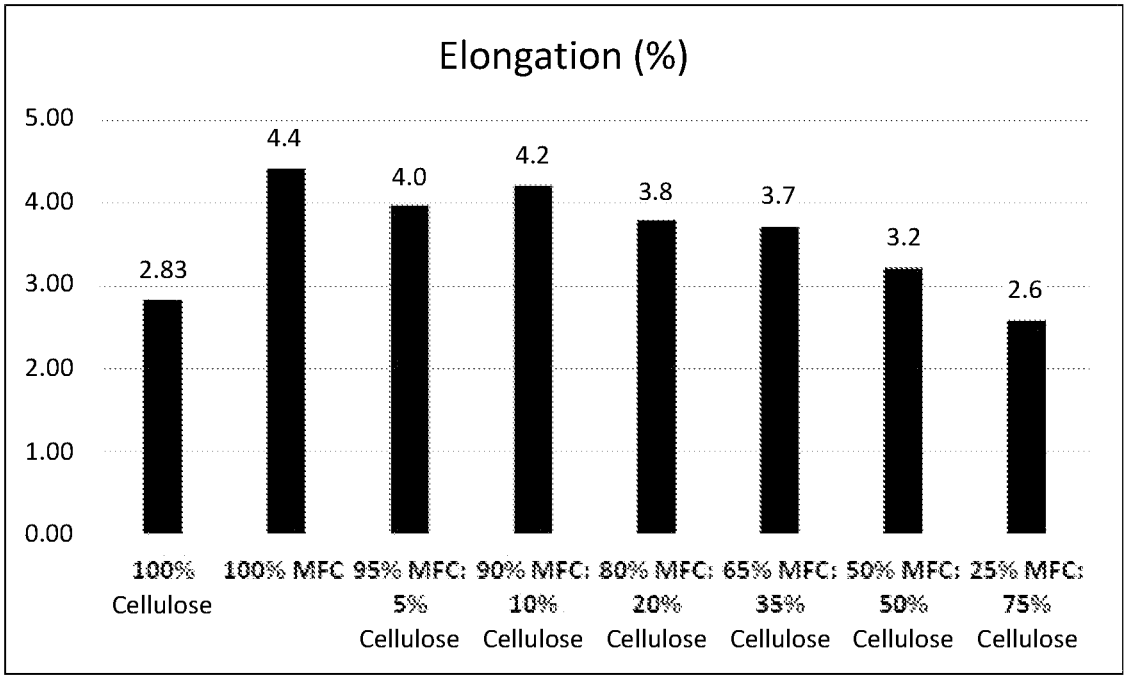
FIG. 09 depicts an elongation graph, in %, of the formulations from example 1 of the invention.
Figure 10:
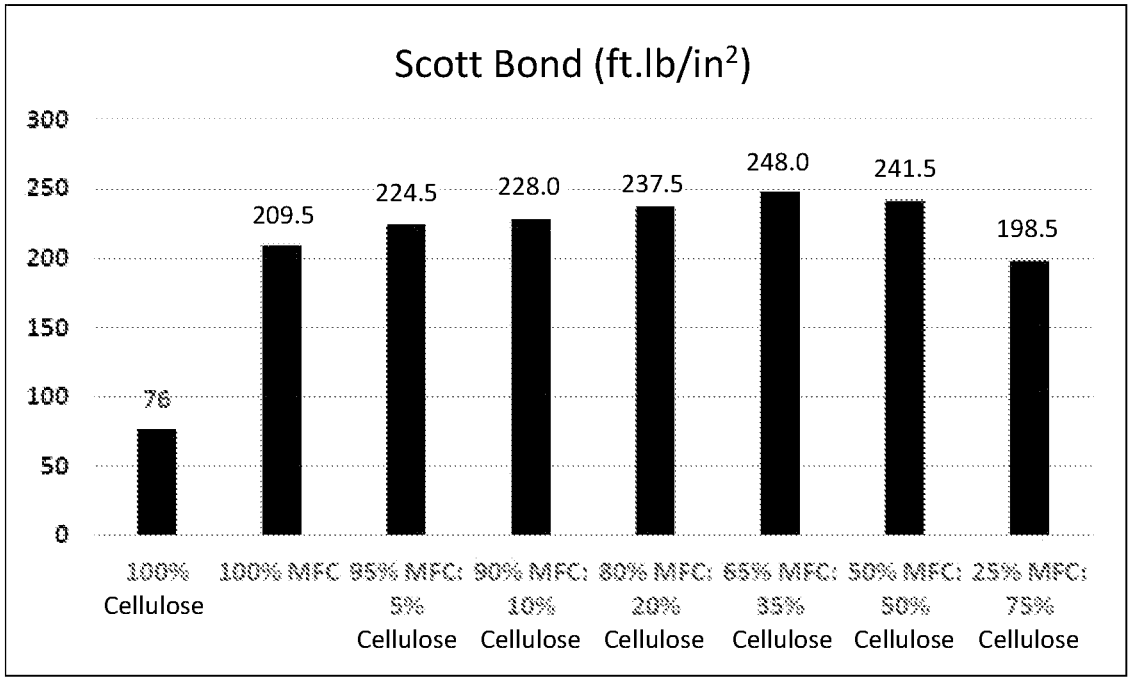
FIG. 10 depicts a Scott Bond, in ft·lb/in$^2$, of the formulations from Example 1 of the invention.
Figure 11:
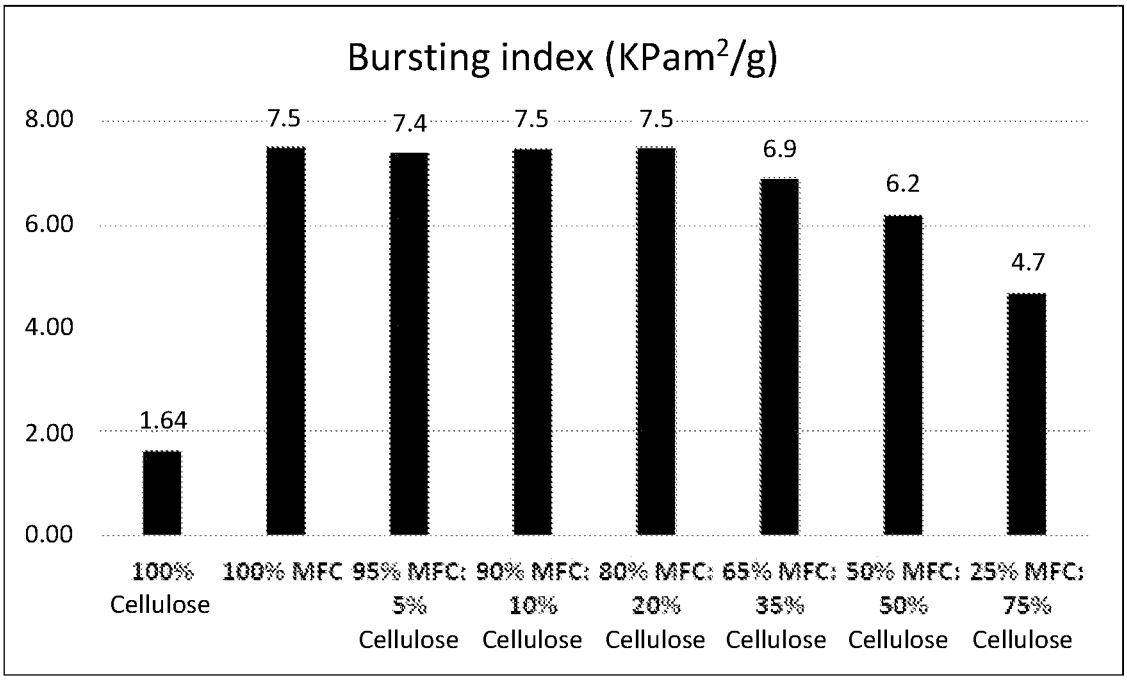
FIG. 11 depicts a bursting index graph, in KPam$^2$/g, of the formulations from example 1 of the invention.
Figure 12:
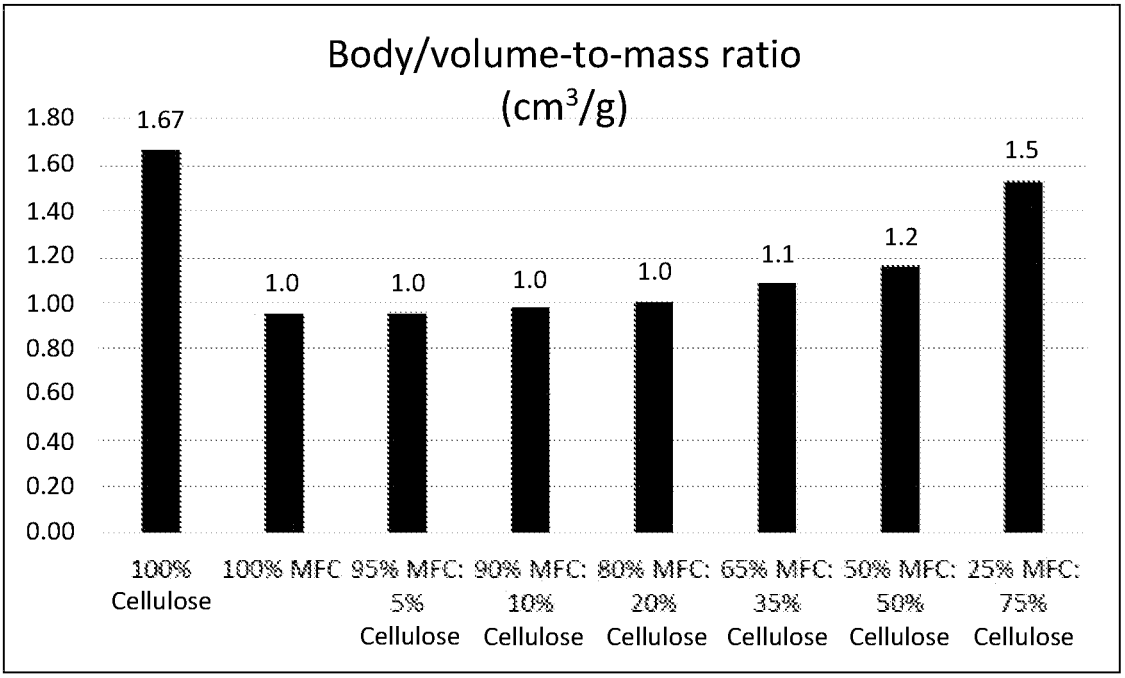
FIG. 12 depicts a body, also referred to as volume-to-mass ratio, graph, in cm$^3$/g, of the formulations from Example 1 of the invention.
Figure 13:
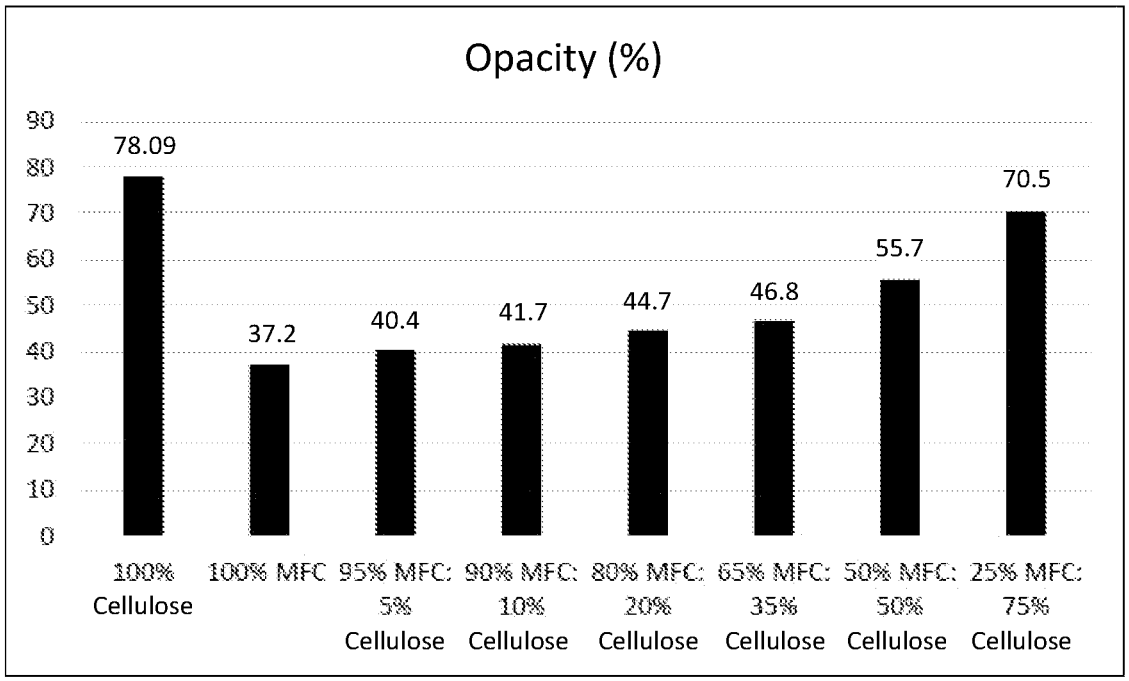
FIG. 13 depicts an opacity graph, in %, of the formulations from example 1 of the invention.
Figure 14:
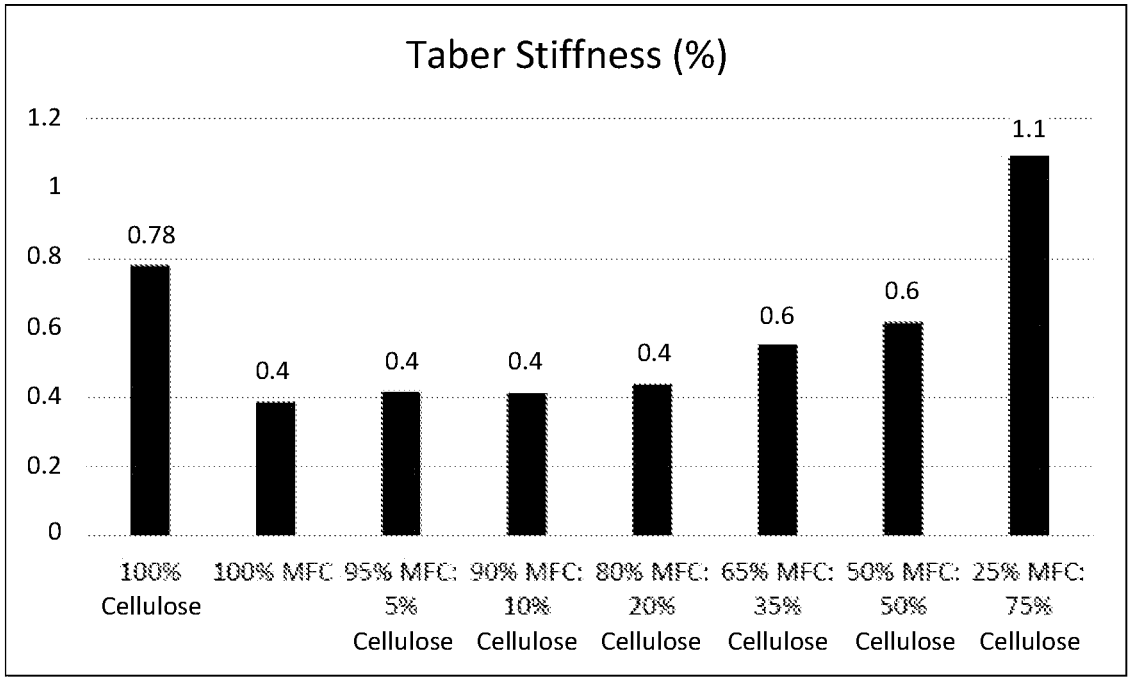
FIG. 14 depicts a Taber stiffness graph, in %, of the formulations from example 1 of the invention.
Figure 15:
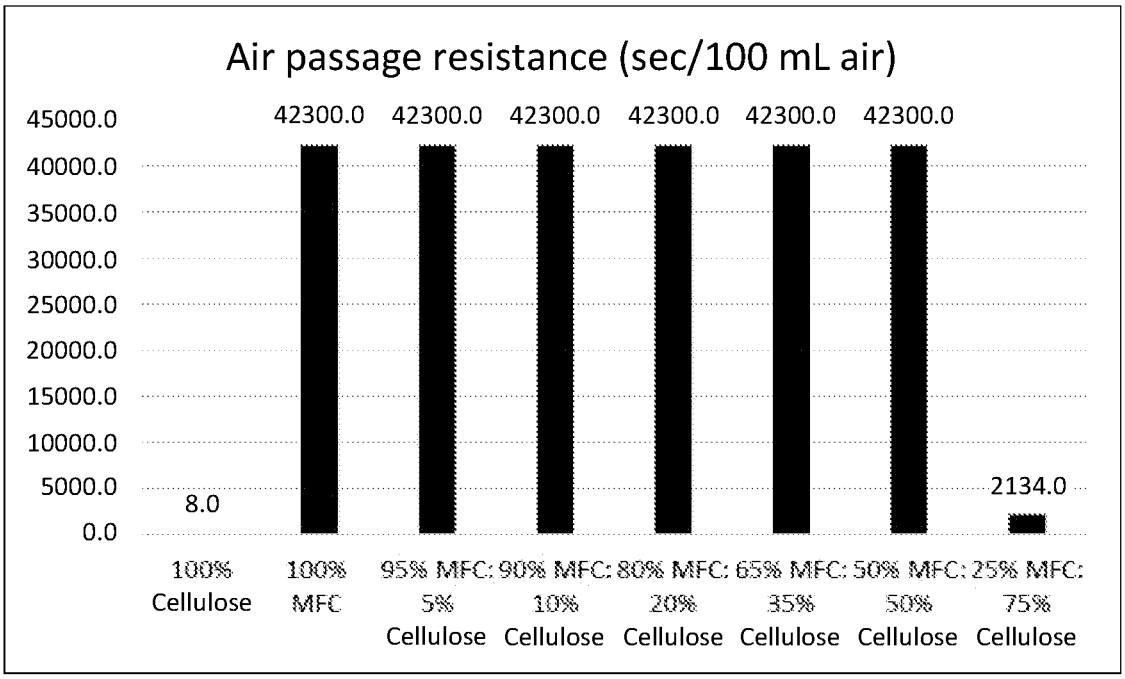
FIG. 15 depicts an air passage resistance (RPA) graph, in sec/100 mL air, of the formulations from example 1 of the invention.
Figure 16:
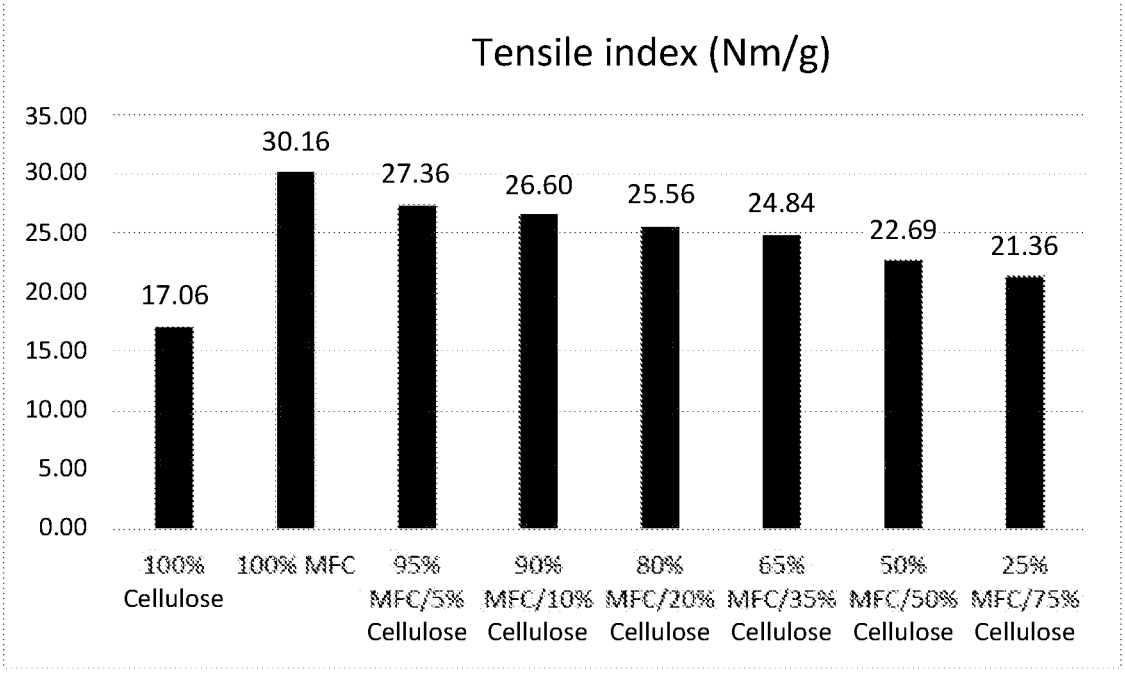
FIG. 16 depicts a tensile graph, in Nm/g, of the formulations from example 2 of the invention.
Figure 17:
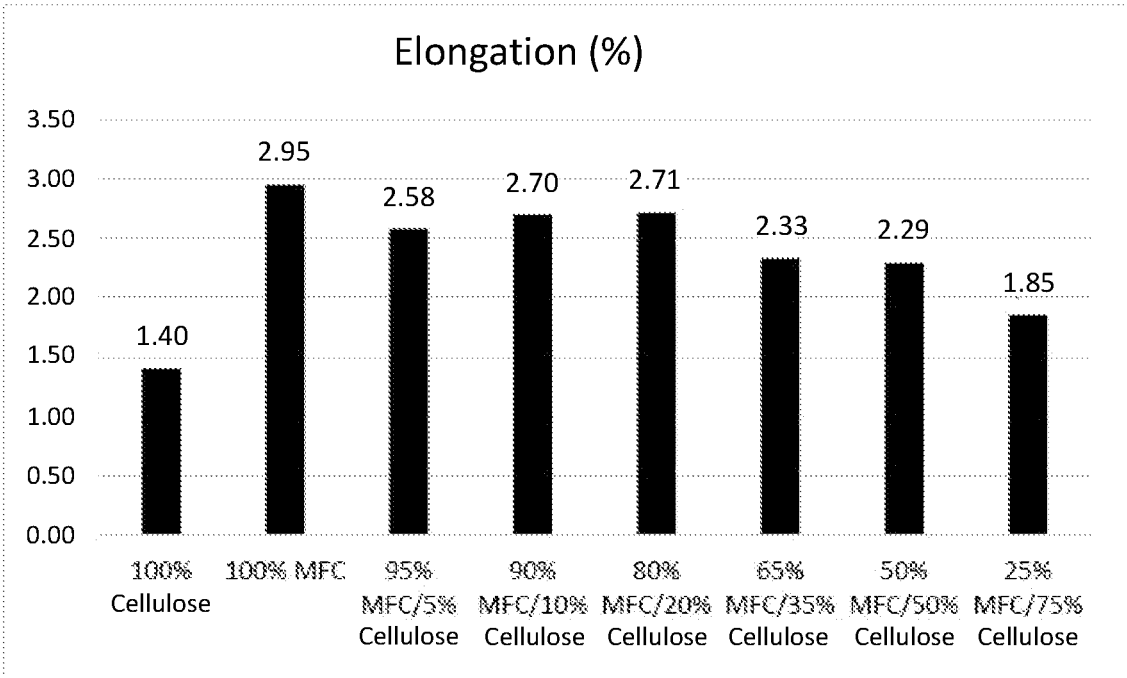
FIG. 17 depicts an elongation graph, in %, of the formulations from example 2 of the invention.
Figure 18:
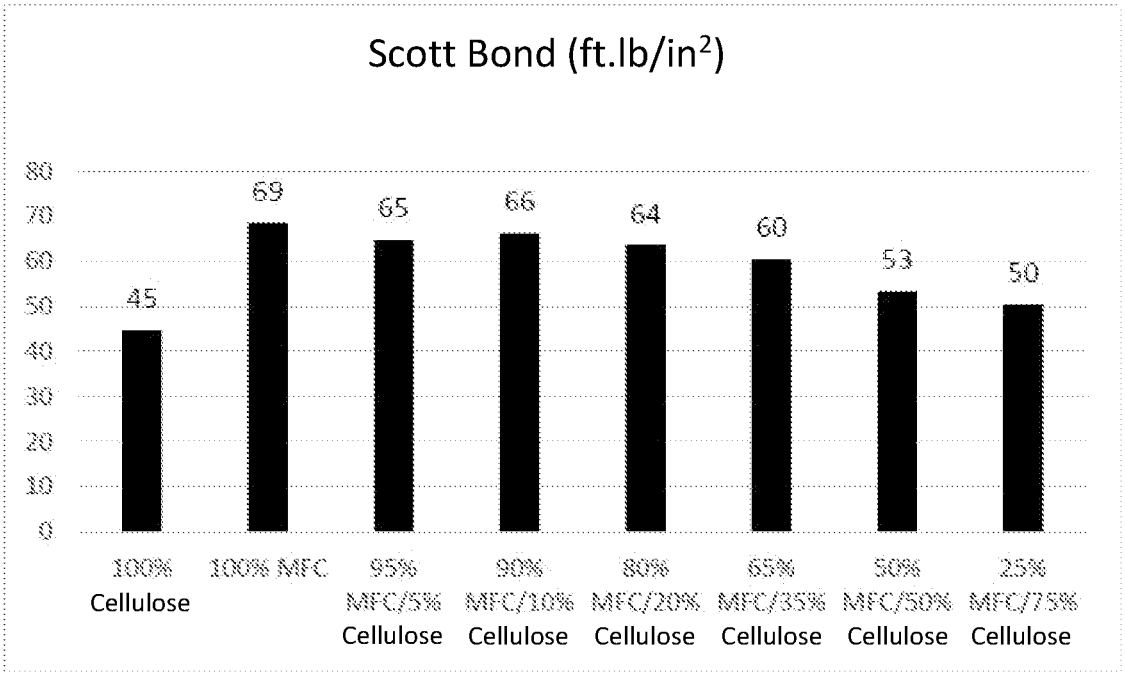
FIG. 18 depicts a Scott Bond, in ft·lb/in$^2$, of the formulations from Example 2 of the invention.
Figure 19:
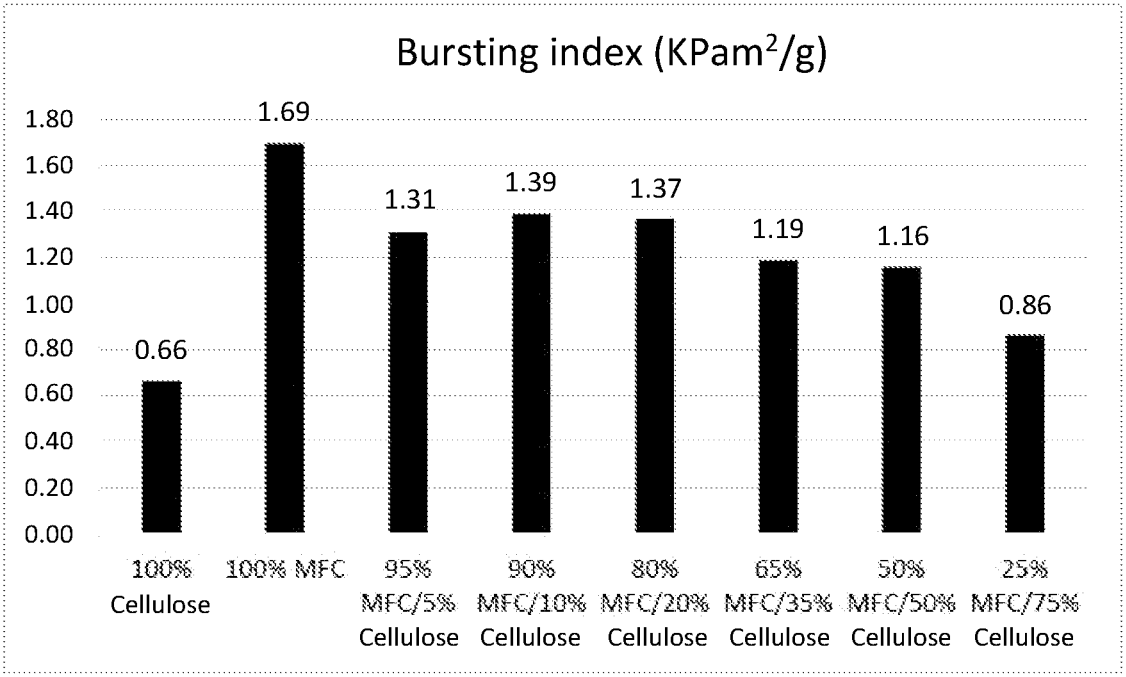
FIG. 19 depicts a bursting index graph, in KPam$^2$/g, of the formulations from example 2 of the invention.
Figure 20:
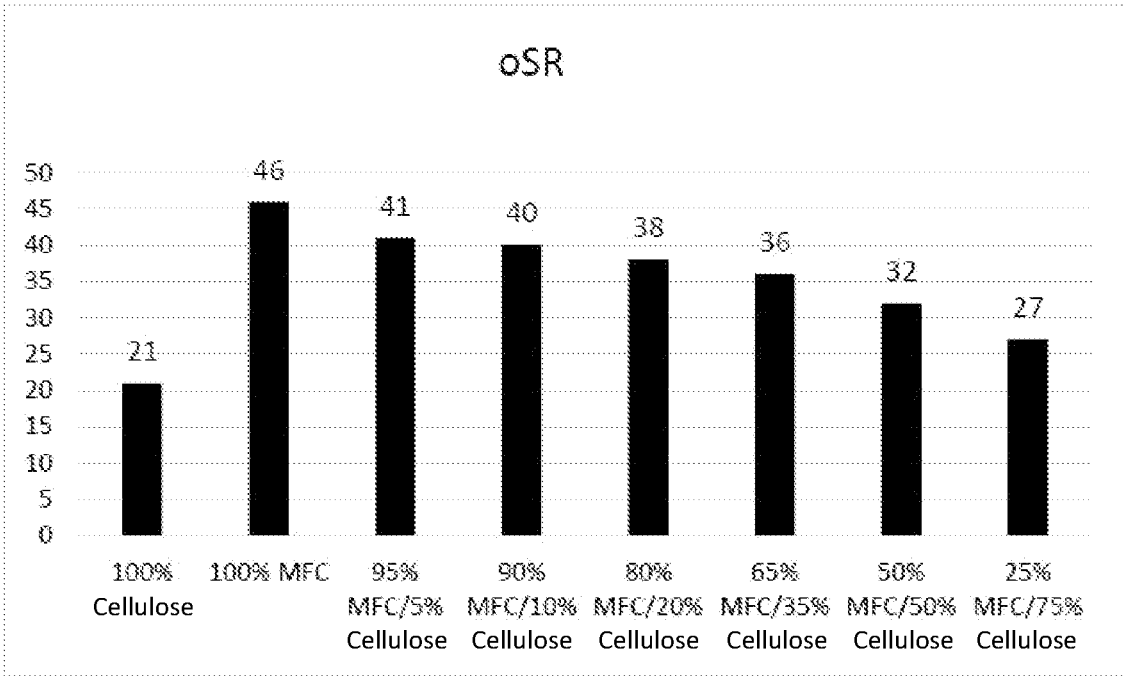
FIG. 20 depicts an oSR graph of the formulations from example 2 of the invention.
Figure 21:
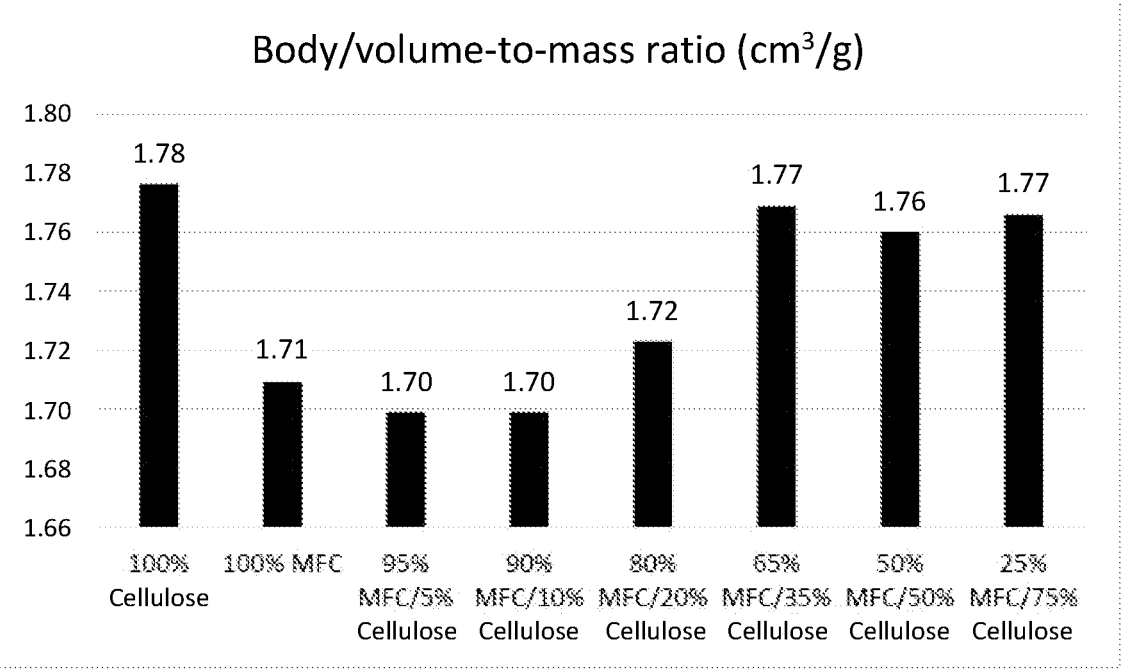
FIG. 21 depicts a body, also referred to as volume-to-mass ratio, graph, in cm$^3$/g, of the formulations from Example 2 of the invention.
Figure 22:
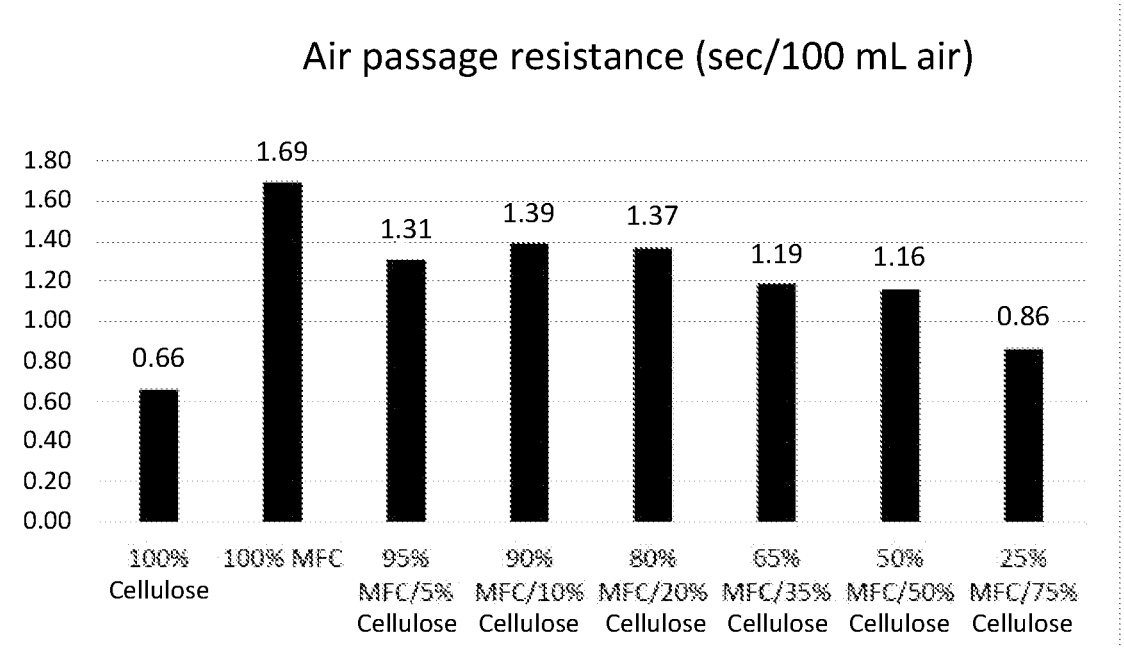
FIG. 22 depicts an air passage resistance graph, in sec/100 mL air, of the formulations from example 2 of the invention.
Figure 23:
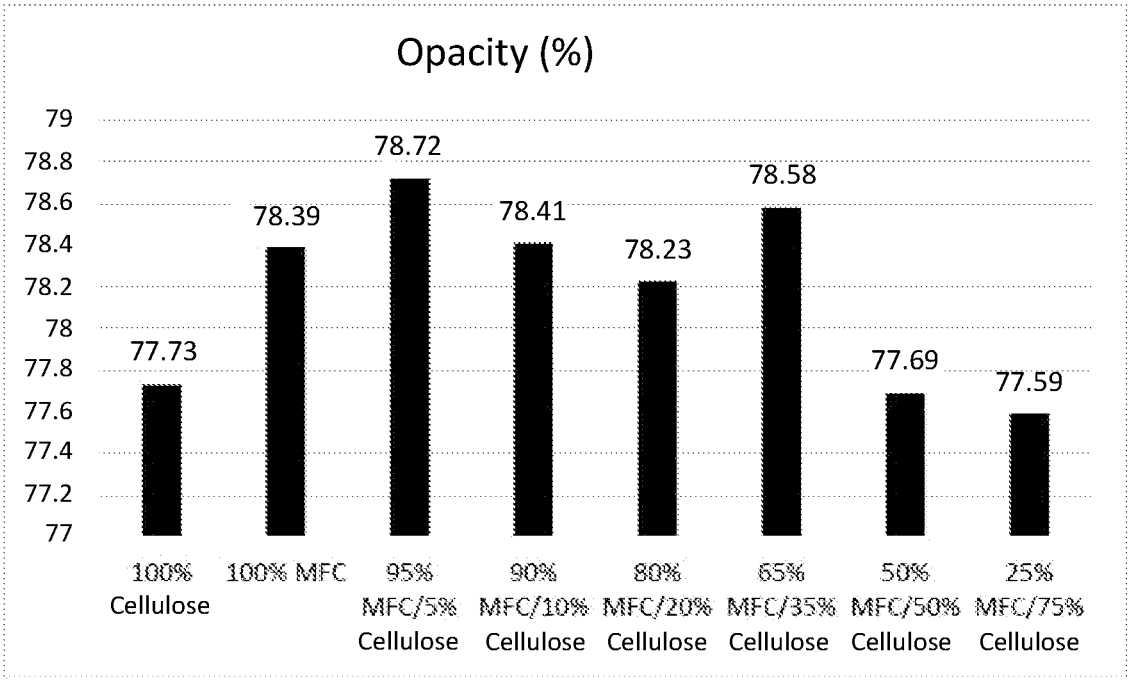
FIG. 23 depicts an opacity graph, in %, of the formulations from example 2 of the invention.
Figure 24:
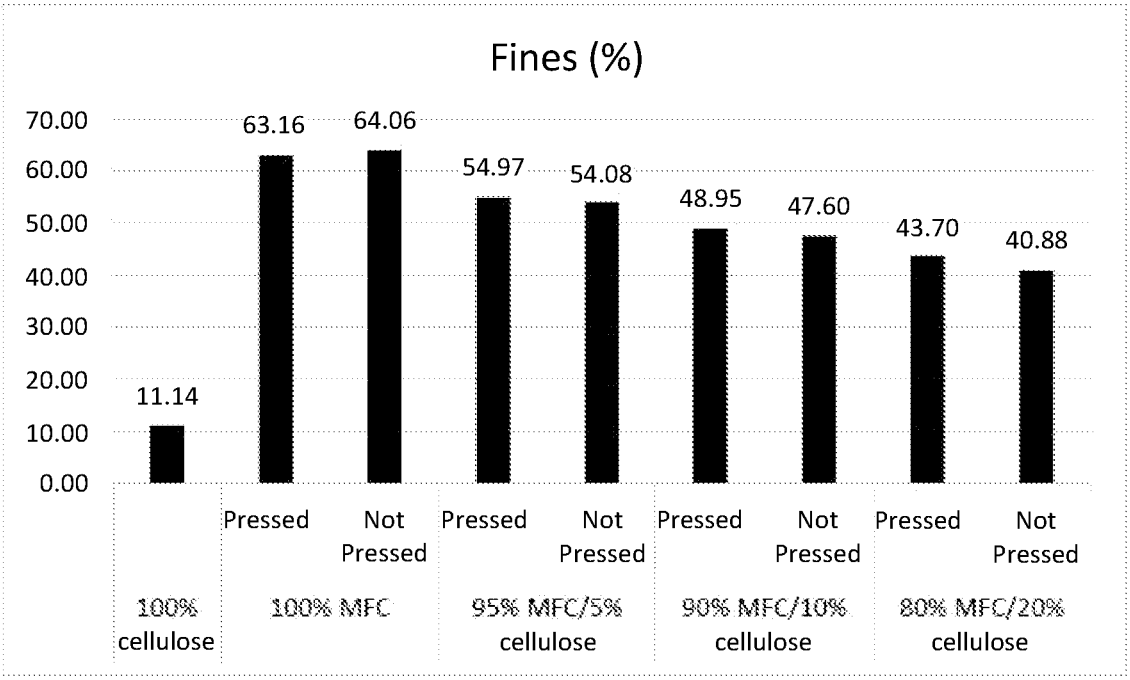
FIG. 24 depicts a fines content graph, in %, of the formulations from example 3 of the invention.
Figure 25:
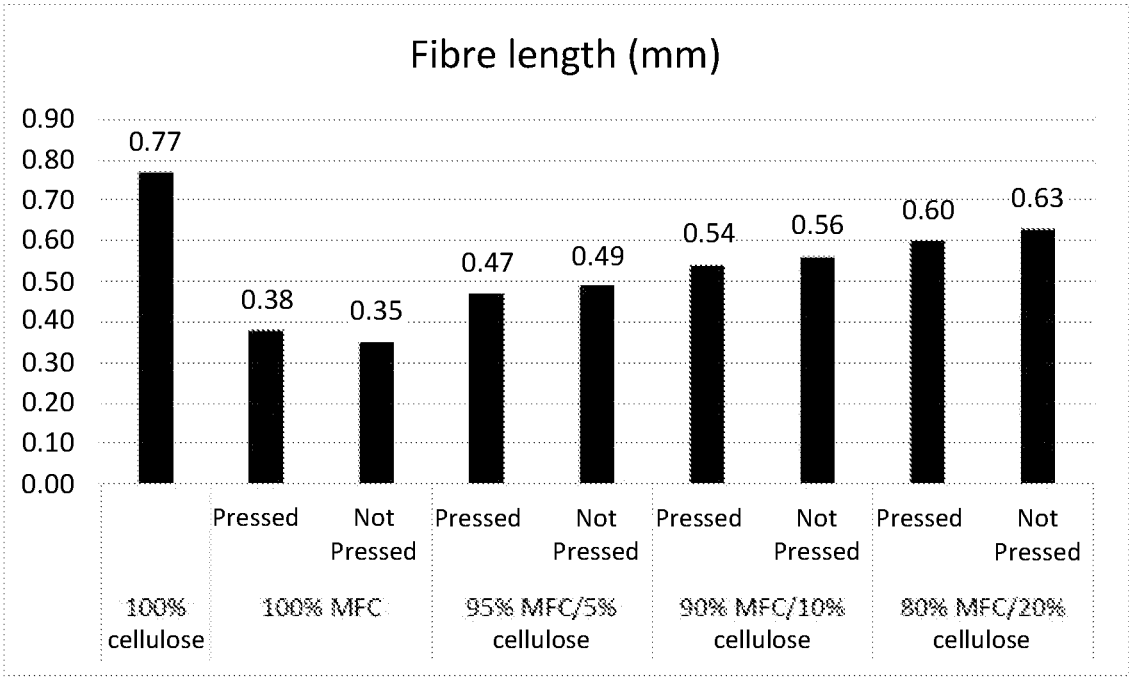
FIG. 25 depicts a fibres length graph, in mm, of the formulations from example 3 of the invention.
Figure 26:
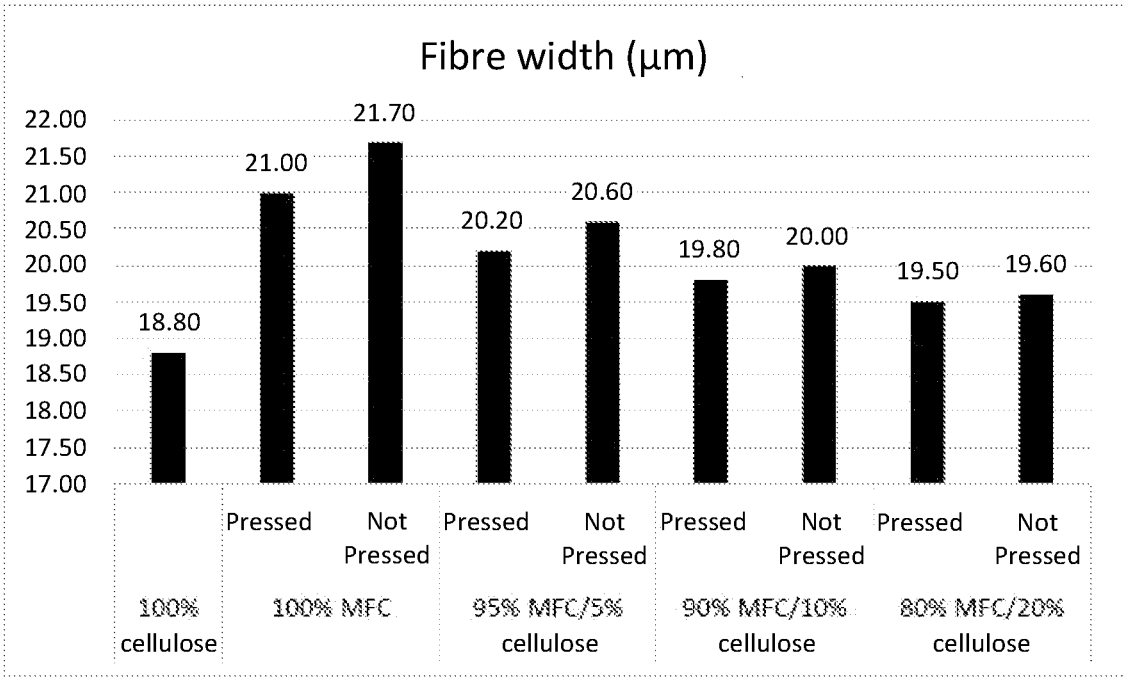
FIG. 26 depicts a fibres width graph, in μm, of the formulations from example 3 of the invention.
Figure 27:
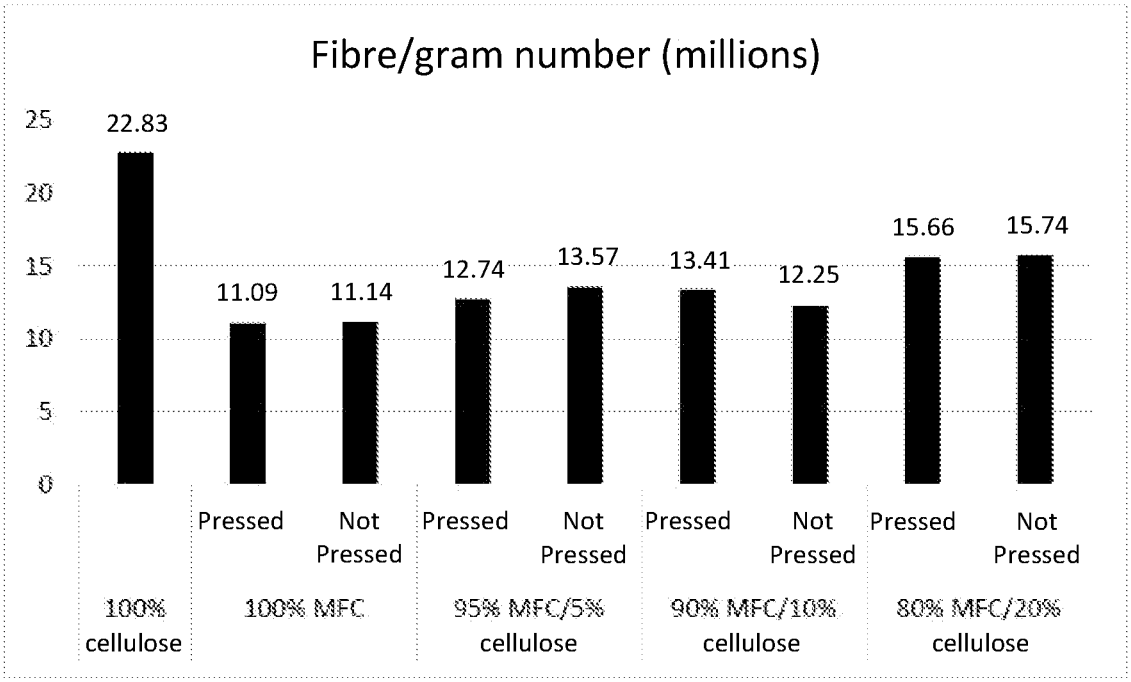
FIG. 27 depicts a graph of the number of fibres per mass from the composition, in millions/gram, of the formulations from example 3 of the invention.
Figure 28:
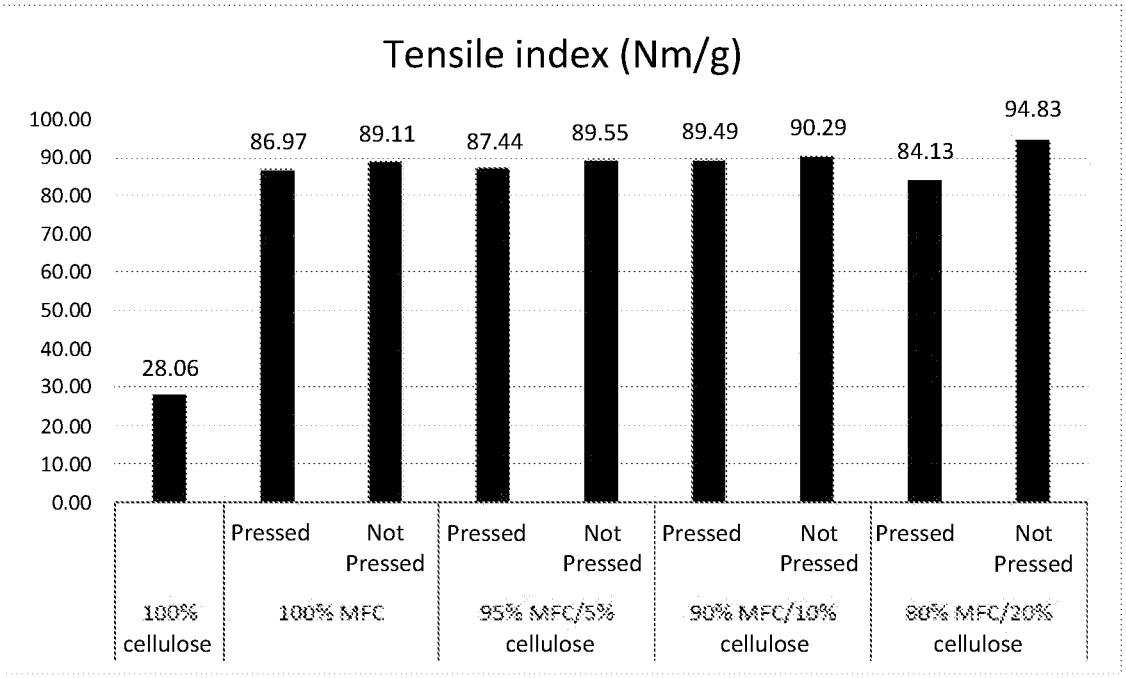
FIG. 28 depicts a tensile index graph, in Nm/g, of the formulations from example 3 of the invention.
Figure 29:
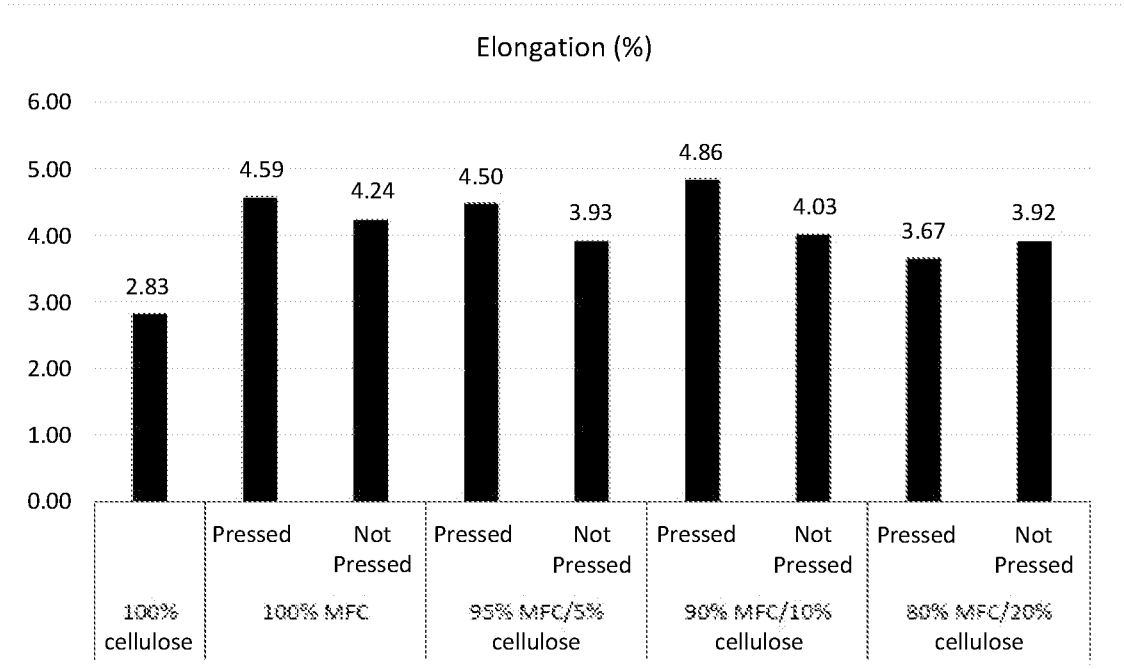
FIG. 29 depicts an elongation graph, in %, of the formulations from example 3 of the invention.
Figure 30:
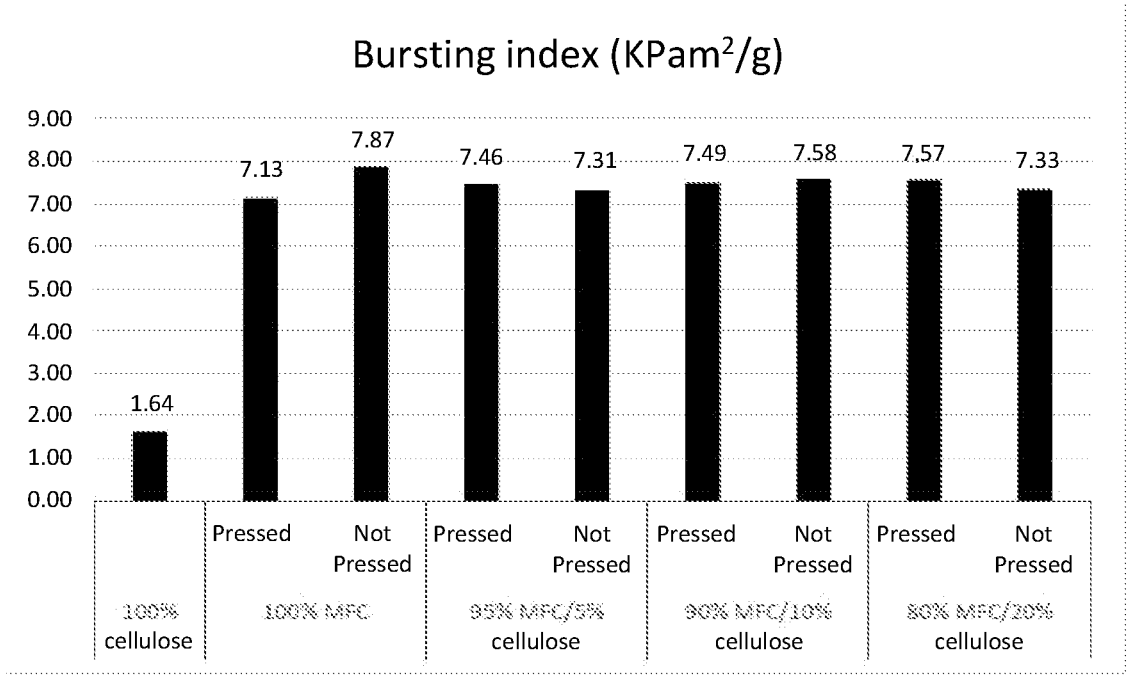
FIG. 30 depicts a bursting index graph, in KPam$^2$/g, of the formulations from example 3 of the invention.
Figure 31:
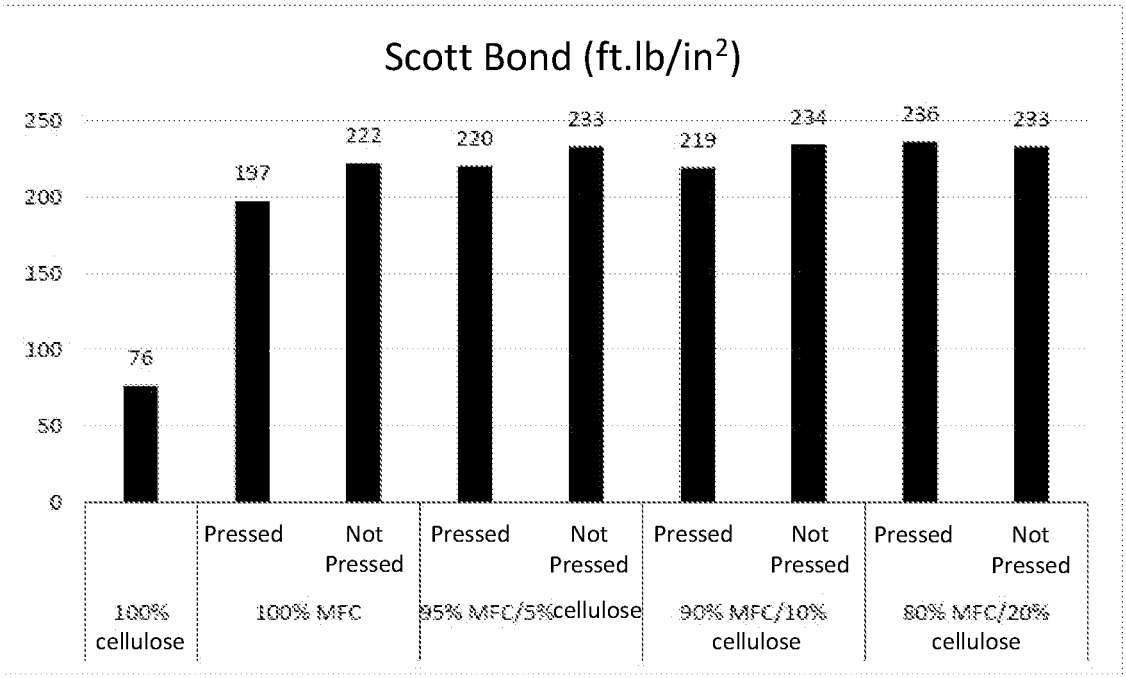
FIG. 31 depicts a Scott Bond, in ft·lb/in$^2$, of the formulations from Example 3 of the invention.
Figure 32:
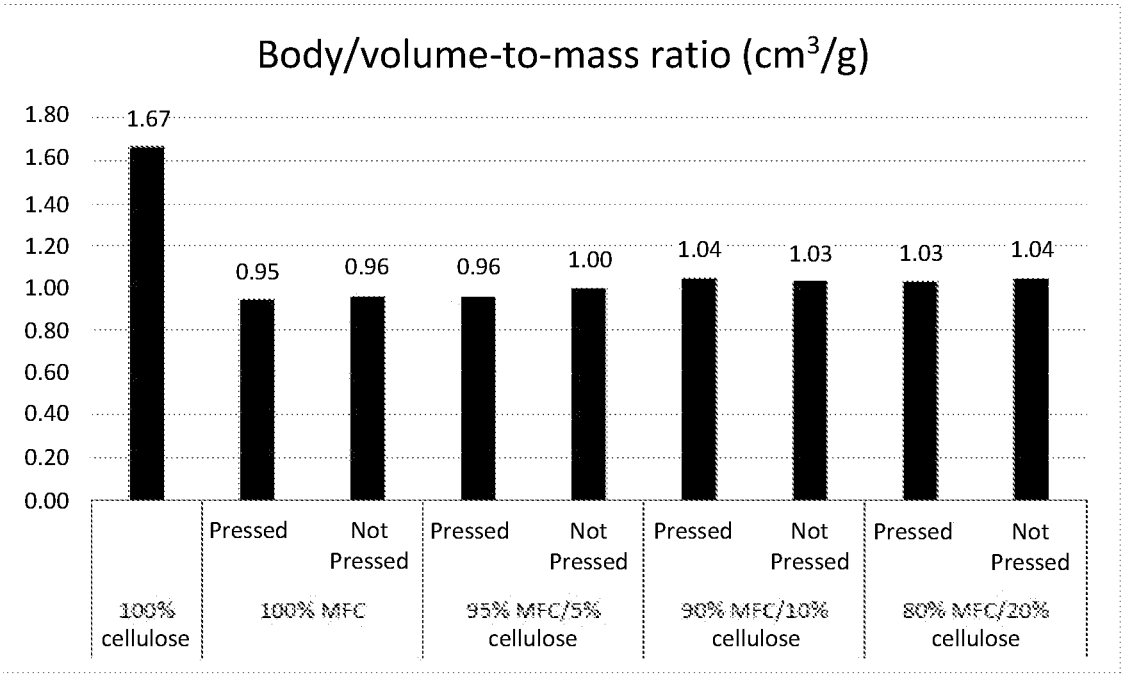
FIG. 32 depicts a body, also referred to as volume-to-mass ratio, graph, in cm$^3$/g, of the formulations from Example 3 of the invention.
Figure 33:
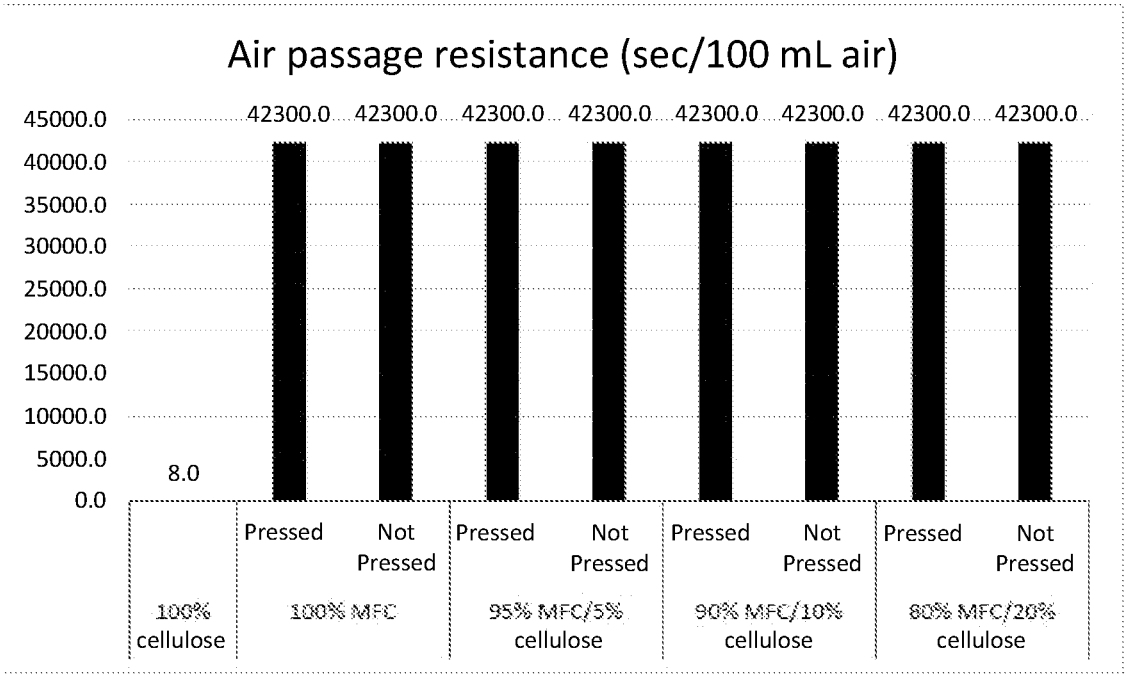
FIG. 33 depicts an air passage resistance graph, in sec/100 mL air, of the formulations from example 3 of the invention.
Figure 34:
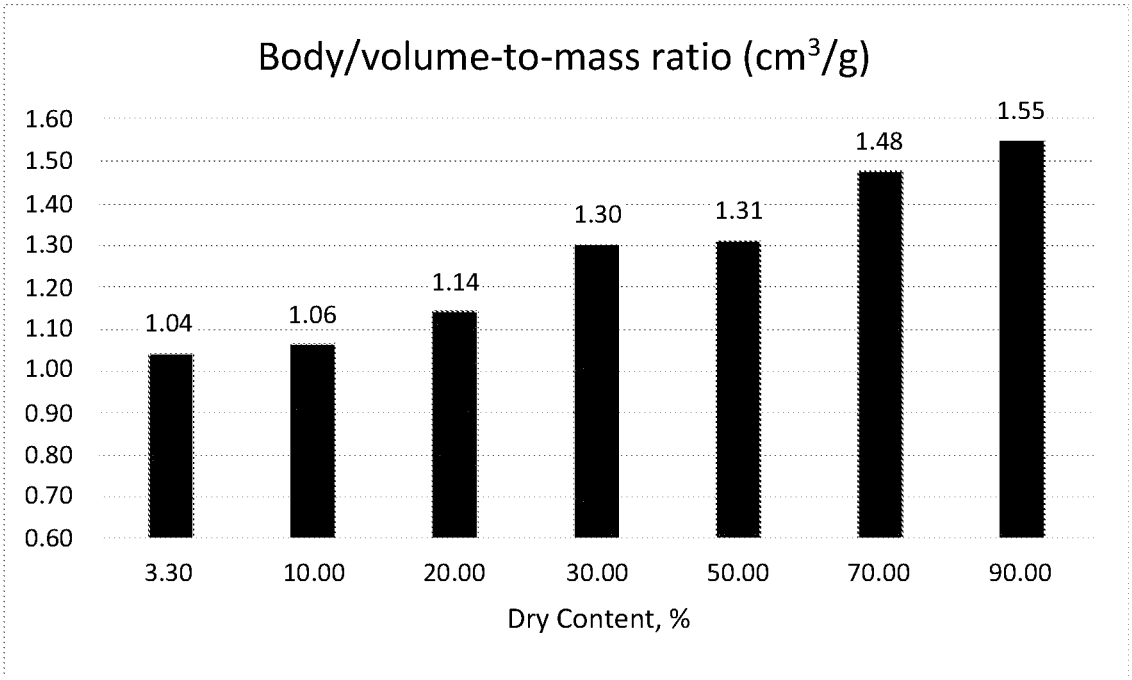
FIG. 34 depicts a body, also referred to as volume-to-mass ratio, graph, in cm$^3$/g, of the formulations from Example 4 of the invention.
Figure 35:
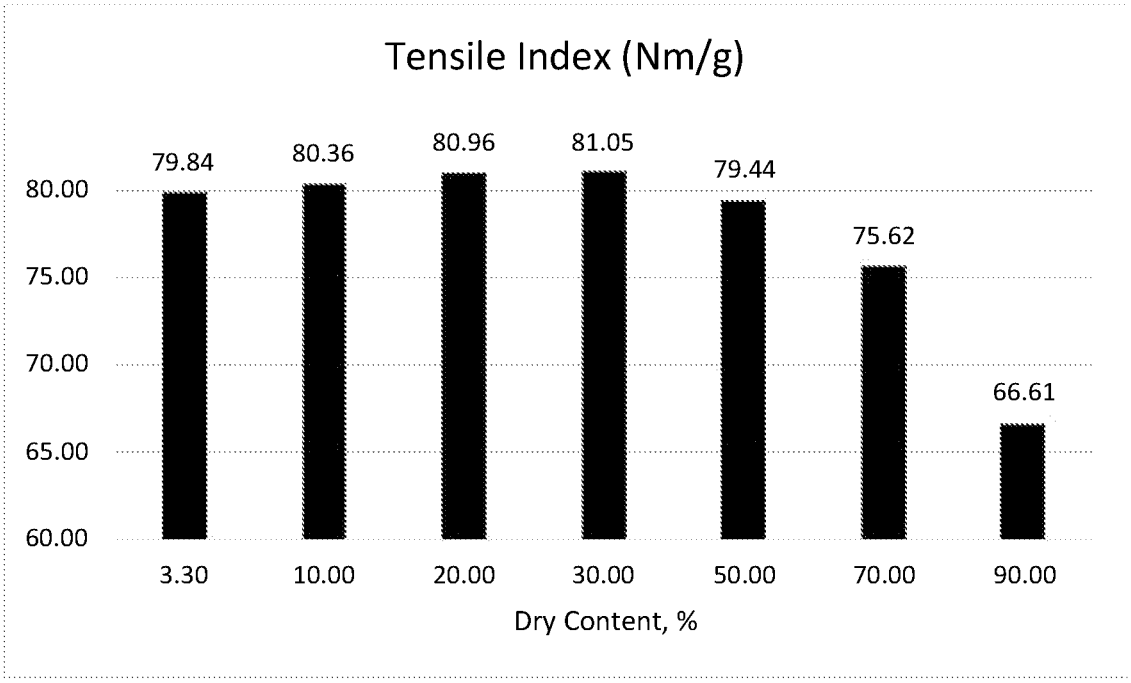
FIG. 35 depicts a tensile index graph, in Nm/g, of the formulations from example 4 of the invention.
Figure 36:
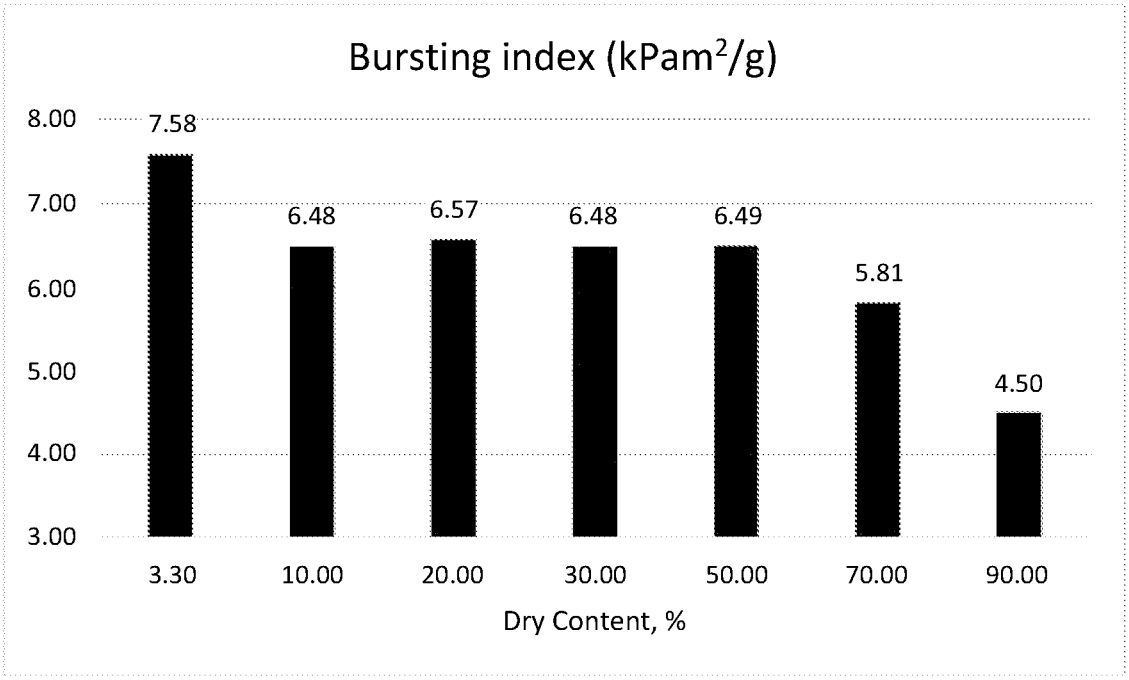
FIG. 36 depicts a bursting index graph, in KPam$^2$/g, of the formulations from example 4 of the invention.
Figure 37:
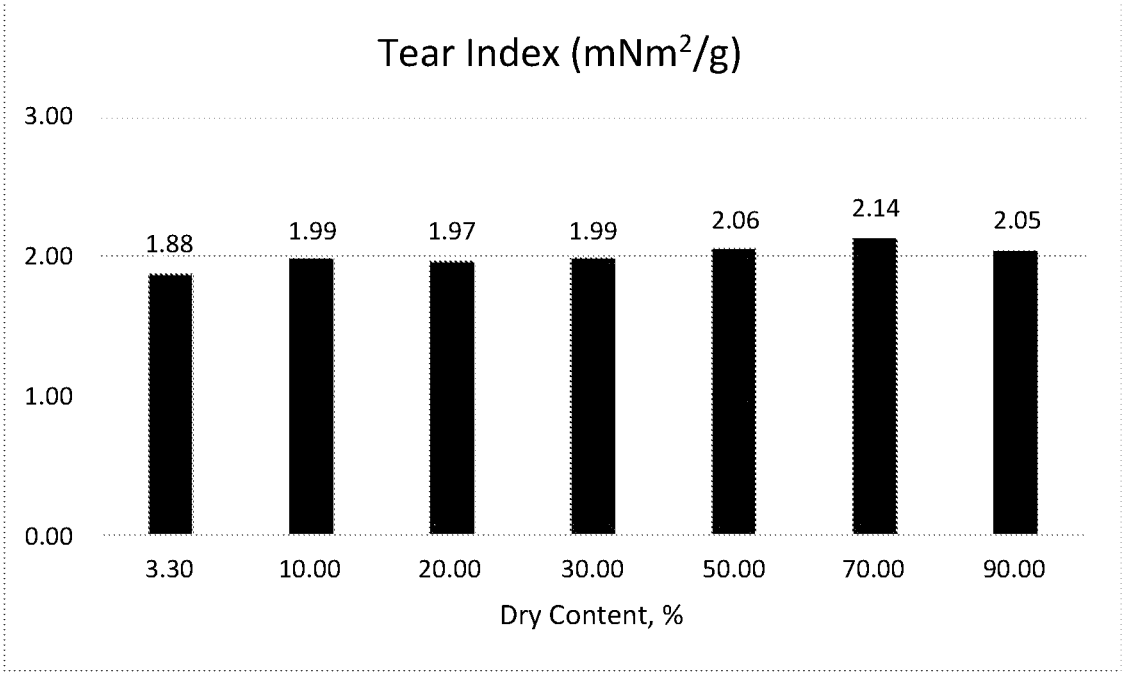
FIG. 37 depicts a tear index graph, in mNm$^2$/g, of the formulations from example 4 of the invention.

The results obtained are presented in the graphs of FIGS. 05, 06 and 07.

The physical-mechanical properties of the formulations are shown in Tables 3 and 4.

TABLE 3

| Formulation | Tension (Nm/g) | Elongation (%) | Scott Bond (ft · lb/in$^2$) | Bursting index (KPam$^2$/g) |
|---|---|---|---|---|
| C100 | 28.06 | 2.83 | 76 | 1.64 |
| C0 | 88.0 | 4.4 | 209.5 | 7.5 |
| C5 | 88.6 | 4.0 | 224.5 | 7.4 |
| C10 | 93.1 | 4.2 | 228.0 | 7.5 |
| C20 | 94.6 | 3.8 | 237.5 | 7.5 |
| C35 | 91.8 | 3.7 | 248.0 | 6.9 |
| C50 | 92.2 | 3.2 | 241.5 | 6.2 |
| C75 | 70.8 | 2.6 | 198.5 | 4.7 |

TABLE 4

| Formulation | Body, also referred to as volume-to-mass ratio (cm$^3$/g) | Opacity (%) | Taber Stiffness (%) | Air passage resistance (sec/100 mL air) |
|---|---|---|---|---|
| C100 | 1.67 | 78.09 | 0.78 | 8.0 |
| C0 | 1.0 | 37.2 | 0.4 | 42300.0 |
| C5 | 1.0 | 40.4 | 0.4 | 42300.0 |
| C10 | 1.0 | 41.7 | 0.4 | 42300.0 |

TABLE 4-continued

| Formulation | Body, also referred to as volume-to-mass ratio (cm$^3$/g) | Opacity (%) | Taber Stiffness (%) | Air passage resistance (sec/100 mL air) |
|---|---|---|---|---|
| C20 | 1.0 | 44.7 | 0.4 | 42300.0 |
| C35 | 1.1 | 46.8 | 0.6 | 42300.0 |
| C50 | 1.2 | 55.7 | 0.6 | 42300.0 |
| C75 | 1.5 | 70.5 | 1.1 | 2134.0 |

The results presented in tables 3 and 4 are depicted in the graphs of FIGS. 08, 09, 10, 11, 12, 13, 14, and 15.

The results obtained show that with up to 50% additivation, there is no loss of mechanical or physical-mechanical strength properties in relation to CO, except for elongation and bursting index properties, with significant opacity gain.

Example 2

This second study evaluates the physical-mechanical properties of paper sheets (article—final product), in which the fibre composition of the invention was applied. Sheets of paper were analyzed with the addition of 5% of the MFC fibre composition of the invention, additivated or not with cellulose. Sheets of paper treated with the MFC fibre composition of the invention were compared to sheets of paper to which only cellulose was added.

Formulation CO represents the MFC fibre composition of the invention, without whitened *eucalyptus* kraft cellulose additivation.

Formulations C5, C10, C20, C35, C50 and C75 represent MFC fibre compositions according to the invention, additivated with, respectively, 5%, 10%, 20%, 35%, 50% and 75% of whitened *eucalyptus* kraft cellulose.

Formulation C100 represents a formulation having 100% cellulose.

The paper sheet physical-mechanical properties, in which the fibre composition of the invention and only cellulose were applied, are found in Tables 5 and 6.

TABLE 5

| Formulation | Tension (Nm/g) | Elongation (%) | Scott Bond (ft · lb/in$^2$) | Bursting index (KPam$^2$/g) |
|---|---|---|---|---|
| C100 | 17.06 | 1.40 | 45 | 0.66 |
| C0 | 30.16 | 2.95 | 69 | 1.69 |
| C5 | 27.36 | 2.58 | 65 | 1.31 |
| C10 | 26.60 | 2.70 | 66 | 1.39 |
| C20 | 25.56 | 2.71 | 64 | 1.37 |
| C35 | 24.84 | 2.33 | 60 | 1.19 |
| C50 | 22.69 | 2.29 | 53 | 1.16 |
| C75 | 21.36 | 1.85 | 50 | 0.86 |

TABLE 6

| Formulation | oSR* | Body, also referred to as volume-to-mass ratio (cm$^3$/g) | Air passage resistance (sec/100 mL air) | Opacity (%) |
|---|---|---|---|---|
| C100 | 21 | 1.78 | 0.66 | 77.73 |
| C0 | 46 | 1.71 | 1.69 | 78.39 |
| C5 | 41 | 1.70 | 1.31 | 78.72 |
| C10 | 40 | 1.70 | 1.39 | 78.41 |
| C20 | 38 | 1.72 | 1.37 | 78.23 |

TABLE 6-continued

| Formulation | oSR* | Body, also referred to as volume-to-mass ratio ($cm^3/g$) | Air passage resistance (sec/100 mL air) | Opacity (%) |
|---|---|---|---|---|
| C35 | 36 | 1.77 | 1.19 | 78.58 |
| C50 | 32 | 1.76 | 1.16 | 77.69 |
| C75 | 27 | 1.77 | 0.86 | 77.59 |

The results obtained in the present study are presented in the graphs from FIGS. 16, 17, 18, 19, 20, 21, 22, and 23.

The results obtained show that when applied to the paper, the addition of the composition of the invention generates an average tensile gain of almost 50% in relation to pure cellulose; and 100% gain in bursting index.

Example 3

A study is presented herein which demonstrates the redispersion effect of the fibre composition of the invention.

Tested formulations represent MFC fibre compositions without whitened *eucalyptus* kraft cellulose additivation; compositions of MFC fibres additivated with 5%, 10% and 20% of whitened *eucalyptus* kraft cellulose; and formulation with 100% of cellulose.

The morphological and mechanical properties of the formulations were analyzed before and after the pressing step.

The morphological properties analyzed were: fines content (%), fibre length (mm), fibre width (μm) and number of fibres per mass of the composition (millions of fibres/gram).

The analyzed mechanical properties were: tensile index (Nm/g), elongation (%), bursting index ($KPam^2/g$), Scott Bond ($ft{\cdot}lb/in^2$), body, also referred to as volume-to-mass ratio, ($cm^3/g$) and air passage resistance (s/100 mL air).

The obtained results are presented in the graphs from FIGS. 24, 25, 26, 27, 28, 29, 30, 31, 32 and 33.

Through the obtained results, it is concluded that there is retention of cellulose in the MFC maintaining the properties of the fibre proportion in the composition with regard to its morphology. Furthermore, no significant differences were observed in formulations before and after pressing.

Example 4

A verification study for dry content levels of the fibre composition of the invention is presented herein.

The physical-mechanical properties of the body, also referred to as volume-to-mass ratio, ($cm^3/g$), tensile index (Nm/g), bursting index ($KPam^2/g$) and tear index ($mNm^2/g$) for different dry content (%) were analyzed.

The results obtained in this study are portrayed in FIGS. 34, 35, 36 and 37.

Through the results, it was concluded that there was a significant body, also referred to as volume-to-mass ratio, gain after 30% dry content and a loss of tensile strength after 30% dry content. Additionally, it was observed that the dry content did not significantly affect the tear strength. Regarding the bursting rate, no significant changes were observed between the dry content levels of 10, 20, 30, and 50%. Therefore, it is clear that redispersibility was achieved up to a maximum of 50% dry content.

The invention claimed is:

1. A fiber composition comprising fibres having a length equal or inferior to 7 mm and a viscosity from 10 to 20 cP, wherein the composition comprises the following fibre length distribution, based on dry weight:

i. 0 to 0.2 mm: 1.7 to 33.7%;
ii. 0.2 to 0.5 mm: 12.0 to 40.0%;
iii. 0.5 to 1.2 mm: 35.0 to 83.0%;
iv. 1.2 to 2.0 mm: 0.10 to 3.8%;
v. 2.0 to 3.2 mm: 0.06 to 0.10%; and
vi. 3.2 to 7.0 mm: 0.03 to 0.30%, wherein the viscosity is measured according to ISO 5351 standard; and the fibres are microfibrillated cellulose (MFC) fibres, alone or in a blend with cellulosic fibres.

2. The fibre composition according to claim 1, wherein it comprises the following fibre length distribution, based on dry weight:

i. 0 to 0.2 mm: 16.5%;
ii. 0.2 to 0.5 mm: 29%;
iii. 0.5 to 1.2 mm: 52%;
iv. 1.2 to 2.0 mm: 1.6%;
v. 2.0 to 3.2 mm: 0.06 to 0.10%; and
vi. 3.2 to 7.0 mm: 0.13%.

3. The fibre composition according to claim 1, wherein the fibres are virgin, recycled, or secondary fibres.

4. The fibre composition according to claim 1, wherein the fibres are obtained via kraft process.

5. The fibre composition according to claim 1, wherein the fibres are whitened, semi-whitened, or not whitened.

6. The fibre composition according to claim 1, wherein the fibres are long or short, wherein the long fibres have a length of more than 2 mm and the short fibres have a length of less than 2 mm.

7. The fibre composition according to claim 1, wherein the fibre composition presents a dry content in the range from 3% to 70%.

8. The fibre composition according to claim 7, wherein the fibre composition presents a dry content in the range from 20% to 50%.

9. The fibre composition according to claim 1, wherein the fibre composition is redispersible.

10. The fibre composition according to claim 9, wherein, when redispersed, the fibre composition presents at least 70% of the Brookfield Viscosity initial value at 1%.

11. The fibre composition according to claim 1, wherein the fibre composition comprises from 10,000 to 25 million fibres/g of the composition.

12. The fibre composition according to claim 1, wherein the fibre composition has a fibre width from 10 to 25 μm.

13. The fibre composition according to claim 1, wherein the fibre composition has a polymerization degree from 1,000 to 2,000 units.

14. The fibre composition according to claim 1, wherein the fibre composition has an opacity from 30 to 80%.

15. The fibre composition according to claim 1, wherein the fibre composition has a fines content of from 10% to 90% and fibrillation of from 5% to 20%.

16. The fibre composition according to claim 1, wherein the fibre composition has Brookfield Viscosity at 1% of from 92 to 326 cP.

17. The fibre composition according to claim 1, wherein the fibre composition is appropriate for use in paper manufacturing, fibre cement, thermoplastic composites, inks, varnishes, adhesives, filters, and/or wooden panels.

18. A method of using a fibre composition according to claim 1, wherein the composition is used for manufacturing of: paper, fibre cement, thermoplastic composites, inks, varnishes, adhesives, filters, and/or wooden panels.

19. An article of manufacture comprising a fibre composition according to claim 1.

20. The article according to claim 19, wherein the article is a paper, fibre cement, a thermoplastic composite, an ink, a varnish, an adhesive, a filter, or a wooden panel.

21. The article according to claim 20, wherein the article is a paper.

22. The article according to claim 21, wherein the paper has a tensile index of from 70 to 100 Nm/g; elongation of from 2 to 5%; Scott Bond of from 180 to 300 ft·lb/in$^2$; and bursting index of from 4 to 9 KPam$^2$/g.

23. The article according to claim 21, wherein the paper has a volume-to-mass ratio of from 1 to 2 cm$^3$/g; Taber stiffness of from 0.3 to 5%; and wall thickness from 3 to 6 μm.

* * * * *